US011545773B2

(12) United States Patent
Coakley et al.

(10) Patent No.: US 11,545,773 B2
(45) Date of Patent: Jan. 3, 2023

(54) TERMINAL-FREE CONNECTORS AND CIRCUITS COMPRISING TERMINAL-FREE CONNECTORS

(71) Applicant: CelLink Corporation, San Carlos, CA (US)

(72) Inventors: Kevin Michael Coakley, Belmont, CA (US); Malcolm Parker Brown, Mountain View, CA (US); Mark Terlaak, San Carlos, CA (US); Will Findlay, San Carlos, CA (US)

(73) Assignee: CelLink Corporation, San Carlos, CA (US)

( * ) Notice: Subject to any disclaimer, the term of this patent is extended or adjusted under 35 U.S.C. 154(b) by 113 days.

(21) Appl. No.: 16/939,912

(22) Filed: Jul. 27, 2020

(65) Prior Publication Data

US 2021/0021068 A1 Jan. 21, 2021

Related U.S. Application Data

(63) Continuation of application No. PCT/US2020/041830, filed on Jul. 13, 2020.
(Continued)

(51) Int. Cl.
*H01R 12/77* (2011.01)
*H01R 12/59* (2011.01)

(52) U.S. Cl.
CPC ..... *H01R 12/777* (2013.01); *H01R 12/59* (2013.01); *H01R 12/774* (2013.01)

(58) Field of Classification Search
None
See application file for complete search history.

(56) References Cited

U.S. PATENT DOCUMENTS 3,994,554 A 11/1976 Navarro
4,109,821 A 8/1978 Lutz
(Continued)

FOREIGN PATENT DOCUMENTS

CN 202434735 U 9/2012
DE 102005041265 A1 3/2007
(Continued)

OTHER PUBLICATIONS

International Application Serial No. PCT/US20/41829, Search Report and Written Opinion dated Oct. 2015/208 pgs.
(Continued)

*Primary Examiner* — Felix O Figueroa
(74) *Attorney, Agent, or Firm* — Polygon IP, LLP

(57) ABSTRACT

Provided are terminal-free connectors for flexible interconnect circuits. A connector for connecting to a flexible interconnect circuit comprises a base comprising a housing chamber defined by at least a first side wall and a second side wall that are oppositely positioned about the base. A circuit clamp is coupled to the base via a first hinge, and is configured to move between a released position and a clamped position. A cover piece is coupled to the base via a second hinge, and is configured to move between an open position and a closed position. The circuit clamp is configured to secure the flexible interconnect circuit between the base and the circuit clamp in the clamped position. One or more protrusions on the circuit clamp are each configured to interface with a socket within the first or second side wall to secure the circuit clamp in the clamped position.

14 Claims, 31 Drawing Sheets

Related U.S. Application Data

(60) Provisional application No. 62/913,131, filed on Oct. 9, 2019, provisional application No. 62/874,586, filed on Jul. 16, 2019.

(56) References Cited

U.S. PATENT DOCUMENTS

| | | | | |
|---|---|---|---|---|
| 5,476,393 | A | 12/1995 | Narita | |
| 5,901,220 | A | 5/1999 | Garver et al. | |
| 6,027,363 | A * | 2/2000 | Watt | H01R 12/772 439/456 |
| 7,682,181 | B1 | 3/2010 | Jones, Jr. et al. | |
| 10,153,570 | B2 | 12/2018 | Coakley et al. | |
| 10,348,009 | B2 | 7/2019 | Coakley et al. | |
| 10,446,956 | B2 | 10/2019 | Coakley et al. | |
| 10,694,618 | B2 | 6/2020 | Coakley et al. | |
| 11,108,175 | B2 | 8/2021 | Coakley et al. | |
| 2003/0082950 | A1 | 5/2003 | Tang | |
| 2006/0035515 | A1 | 2/2006 | Pabst | |
| 2006/0286859 | A1 | 12/2006 | Shimizu et al. | |
| 2007/0077814 | A1 | 4/2007 | Sullivan et al. | |
| 2009/0269968 | A1 | 10/2009 | Nemoto | |
| 2017/0331206 | A1 | 11/2017 | Manba | |
| 2019/0148857 | A1 | 5/2019 | Takase et al. | |
| 2020/0245449 | A1 | 7/2020 | Coakley et al. | |
| 2021/0021066 | A1 | 1/2021 | Coakley et al. | |
| 2022/0006212 | A1 | 1/2022 | Coakley et al. | |

FOREIGN PATENT DOCUMENTS

| | | | |
|---|---|---|---|
| JP | 2002289285 | A | 10/2002 |
| JP | 2002313502 | A | 10/2002 |
| JP | 2005190914 | A | 7/2005 |
| WO | 2021011486 | | 1/2021 |
| WO | 2021011487 | A1 | 1/2021 |

OTHER PUBLICATIONS

International Application Serial No. PCT/US20/41830, Search Report and Written Opinion dated Oct. 2015/209 pgs.

U.S. Appl. No. 16/939,904, Examiner Interview Summary dated Jun. 18, 2021, 2 pgs.

U.S. Appl. No. 16/939,904, Notice of Allowance dated Jun. 24, 2021, 11 pgs.

International Application Serial No. PCT/US20/41829, Preliminary Report on Patentability dated Jan. 27, 2022, 6 pgs.

International Application Serial No. PCT/US20/41830, Preliminary Report on Patentability dated Jan. 27, 2022, 7 pgs.

* cited by examiner

TERMINAL-FREE CONNECTORS AND CIRCUITS COMPRISING TERMINAL-FREE CONNECTORS

CROSS-REFERENCE TO RELATED APPLICATIONS

This application is a continuation of, and claims benefit under 35 U.S.C. § 120 to, International Application No. PCT/US20/41830, which claims the benefit of U.S. Provisional Application No. 62/874,586, entitled TERMINAL-FREE CONNECTORS AND CIRCUITS COMPRISING TERMINAL-FREE CONNECTORS filed on Jul. 16, 2019, and U.S. Provisional Application No. 62/913,131, entitled TERMINAL-FREE CONNECTORS AND CIRCUITS COMPRISING TERMINAL-FREE CONNECTORS filed on Oct. 9, 2019. These applications are incorporated by reference herein in their entirety for all purposes.

BACKGROUND

Electrical power and control signals are typically transmitted to individual components of a vehicle or any other machinery or system using multiple wires bundled together in a harness. In a conventional harness, each wire may have a round cross-sectional profile and may be individually surrounded by an insulating sleeve. The cross-sectional size of each wire is selected based on the material and current transmitted by this wire. Furthermore, resistive heating and thermal dissipation is a concern during electrical power transmission requiring even larger cross-sectional sizes of wires in a conventional harness. Additionally, traditional connectors for joining the interconnect circuits with the individual components may be rather bulky, heavy, and expensive to manufacture. Yet, automotive, aerospace and other industries strive for smaller, lighter, and less expensive components.

What is needed are terminal-free connectors and circuits comprising terminal-free connectors that are lighter and cheaper to manufacture, and which may be configured for flexible interconnect circuits that do not include traditional round cross-sectional profiles.

SUMMARY

The following presents a simplified summary of the disclosure in order to provide a basic understanding of certain s elements of this disclosure. This summary is not an extensive overview of the disclosure, and it does not identify key and critical elements of the present disclosure or delineate the scope of the present disclosure. Its sole purpose is to present some concepts disclosed herein in a simplified form as a prelude to the more detailed description that is presented later.

Provided are terminal-free connectors and circuits comprising terminal-free connectors. In particular, a connector for connecting to a flexible interconnect circuit comprises a housing, and a spring-loaded guide positioned within the housing. The spring-loaded guide urges a flexible interconnect circuit downward as the flexible interconnect circuit is pre-loaded into the housing. The connector further comprises a slider configured to move between an extended position and an inserted position. The slider includes a convex upper surface configured to urge the flexible interconnect circuit upwards in the inserted position.

The housing may further comprise a blade opening configured to receive a blade of a module-side connector inserted through the blade opening. The spring-loaded guide may urge the blade against the pre-loaded flexible interconnect circuit. The convex upper surface urges the flexible interconnect urges the flexible interconnect circuit upwards against the blade.

The housing may comprise a latch configured to interconnect to a strike on the slider to secure the slider in the inserted position. The flexible interconnect circuit may backed with a pressure sensitive adhesive to allow circuit to be tacked to the connector. The convex upper surface of the slider may comprise a grip surface configured with grooves to increase friction against the flexible interconnect circuit when moving from the extended position to the inserted position.

The connector may further comprise a wedge configured to secure the pre-loaded flexible interconnect circuit. The housing may comprise a ledge configured to curl the flexible interconnect circuit downward as the flexible interconnect circuit is pre-loaded into the housing.

In other embodiments, a connector for connecting to a flexible interconnect circuit may comprise a base comprising a housing chamber defined by at least a first side wall and a second side wall. The first side wall and the second side wall are oppositely positioned about the base. The connector further comprises a circuit clamp coupled to the base via a first hinge, and the circuit clamp is configured to move between a released position and a clamped position. The connector further comprises a cover piece coupled to the base via a second hinge, and the cover piece is configured to move between an open position and a closed position.

The circuit clamp may be configured to secure the flexible interconnect circuit between the base and the circuit clamp in the clamped position. The circuit clamp may comprise one or more protrusions, each protrusion configured to interface with a socket within the first side wall or the second side wall to secure the circuit clamp in the clamped position. The circuit clamp may include a convex upper surface, wherein the flexible interconnect circuit conforms to a geometry of the upper surface in the clamped position.

The base may comprise one or more blade openings configured to receive blades of a module-side connector. The cover piece may comprise a contact surface within the housing chamber in the closed position. The contact surface may comprise one or more convex portions which are offset from the convex upper surface of the circuit clamp. The cover piece may one or more protrusions, each protrusion configured to interface with a corresponding socket within the first side wall or the second side wall to secure the cover piece in the closed position.

Also described is a terminal-free connector comprising an insert component comprising a base and a circuit clamp coupled to the base via a first hinge, wherein the circuit clamp is configured to move between a released position and a clamped position. The connector further comprises a housing component comprising housing chamber defined by a first side wall, a second side wall, a floor, an upper contact surface, and an interface surface. In the clamped position, the insert component is configured to secure a flexible interconnect circuit between the circuit clamp and the base, and securely couple to the housing component within the housing chamber.

The circuit clamp may be configured to secure the flexible interconnect circuit between the base and the circuit clamp in the clamped position. The circuit clamp may include a convex upper surface, and the flexible interconnect circuit conforms to a geometry of the upper surface of the circuit clamp in the clamped position.

The housing component may comprise one or more blade openings configured to receive blades of a module-side connector. The upper contact surface of the housing component within the housing chamber comprises one or more convex portions which are offset from the convex upper surface of the circuit clamp.

The circuit clamp may comprise one or more protrusions, each protrusion configured to interface with a socket within the first side wall or the second side wall to secure the circuit clamp in the clamped position.

These and other examples are described further below with reference to the figures.

BRIEF DESCRIPTION OF THE DRAWINGS

The disclosure may best be understood by reference to the following description taken in conjunction with the accompanying drawings, which illustrate particular examples of the present disclosure.

DETAILED DESCRIPTION

In the following description, numerous specific details are set forth in order to provide a thorough understanding of the presented concepts. The presented concepts may be practiced without some or all of these specific details. In other instances, well known process operations have not been described in detail so as to not unnecessarily obscure the described concepts. While some concepts will be described in conjunction with the specific examples, it will be understood that these examples are not intended to be limiting. On the contrary, it is intended to cover alternatives, modifications, and equivalents as may be included within the spirit and scope of the present disclosure as defined by the appended claims.

FIGS. 1A, 1B, 2A, 2B, and 2C—Flexible Interconnect Circuits

Interconnect circuits are used to deliver power and/or signals and used for various applications, such as vehicles, appliances, electronics, and the like. One example of such interconnect circuits is a harness, which typically utilizes electrical conductors having round or rectangular cross-sectional profiles. In a harness, each electrical conductor may be a solid round wire or a stranded set of small round wires. A polymer shell insulates each electrical conductor. Furthermore, multiple insulated electrical conductors may form a large bundle.

Figure 1A:
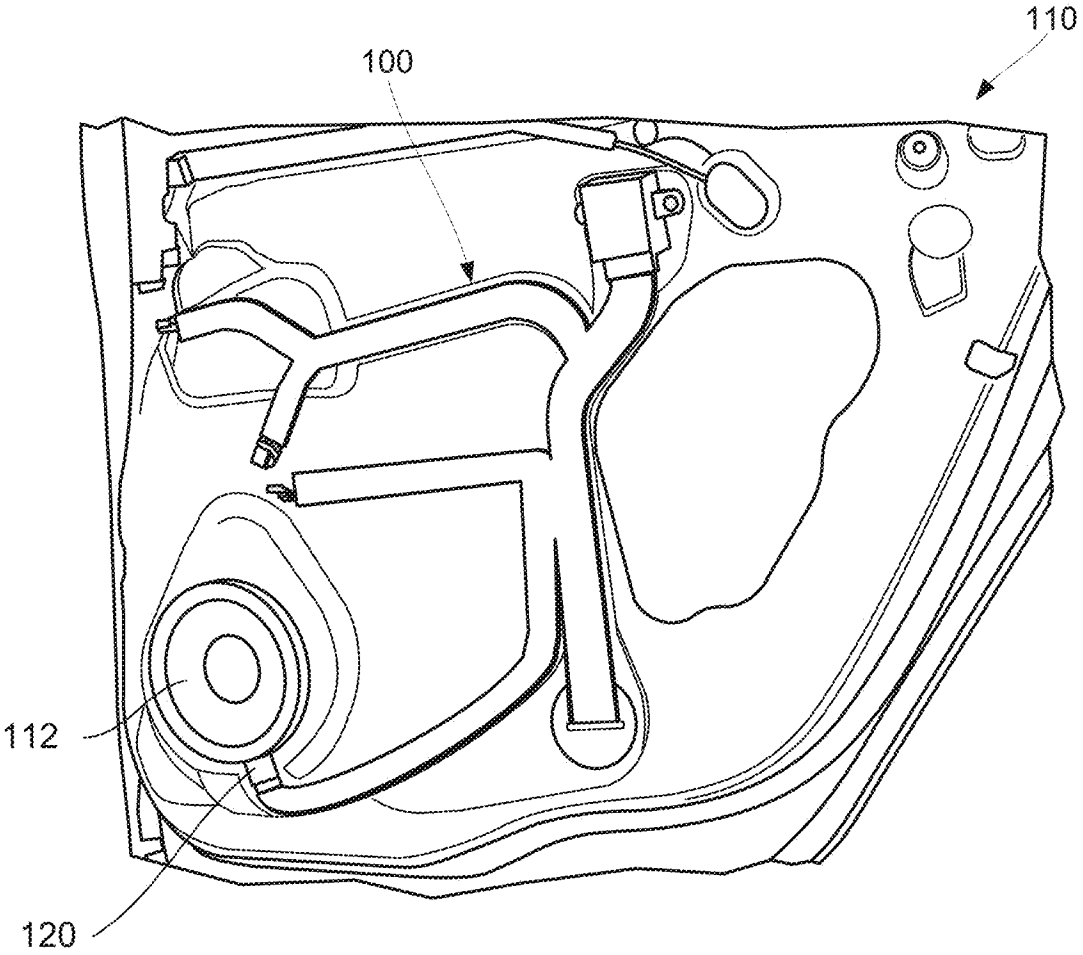
FIG. 1A is a schematic illustration of one example of a flexible hybrid interconnect circuit used in an assembly, in accordance with one or more embodiments.

FIG. 1A is a schematic illustration of one example of flexible hybrid interconnect circuit 100 used in assembly 110. As used herein, a flexible hybrid interconnect circuit may be referred to as a "flex circuit." While assembly 110 is shown as a car door, one having ordinary skill in the art would understand that various other types of vehicle panels (e.g., roof panels, floor panels) and types of vehicles (e.g., aircraft, watercraft) are also within the scope. Furthermore, flexible hybrid interconnect circuit 100 may be a part of or attached to other types of structures (e.g., battery housing), which may be operable as heat sinks or heat spreaders. For example, flexible hybrid interconnect circuit 100 may be used for various appliances (e.g., refrigerators, washers/dryers, heating, ventilation, and air conditioning), aircraft wiring, battery interconnects, and the like.

Provided are novel aspects of securing a flex circuit, such as flex circuit 100, to the male pins (also known as "blades") of an automotive connector without the need for female metal terminals within a female connector. As used herein, an automotive connector may be referred to as a "module-side connector" and a female connector may be referred to as a "circuit-side connector." The elimination of female metal terminals from the system has the potential to reduce weight, size, and cost of a flexible harness. Furthermore, in some examples, the elimination of female terminals provides a much simpler path to making a flex harness backward compatible with a round wire harness. For example, 3D printing may be used to produce a semi-custom female plastic connector that mates with a given male plastic connector.

Securing functions of the certain flex circuits described herein may be based exclusively on a plastic component (and no female metal terminals). The securing functions involve (1) securing the flexible circuit to a female connector housing, (2) securing the female connector housing to a male connector housing, and (3) securing the flex circuit to the male connector pins. Various features of flexible circuits, described herein, provide these securing functions. It should be noted that these three securing functions are provided by the same component, which may be referred to as a connector housing. In some examples, the connector housing may be an assembly of two or more plastic subcomponents.

Specifically, the connector housing forms one or more latch systems, such that each of these three securing functions is accomplished by a separate latch system. In some examples, the number of latches systems, needed to accomplish these three securing functions is two or even one.

Figure 1B:
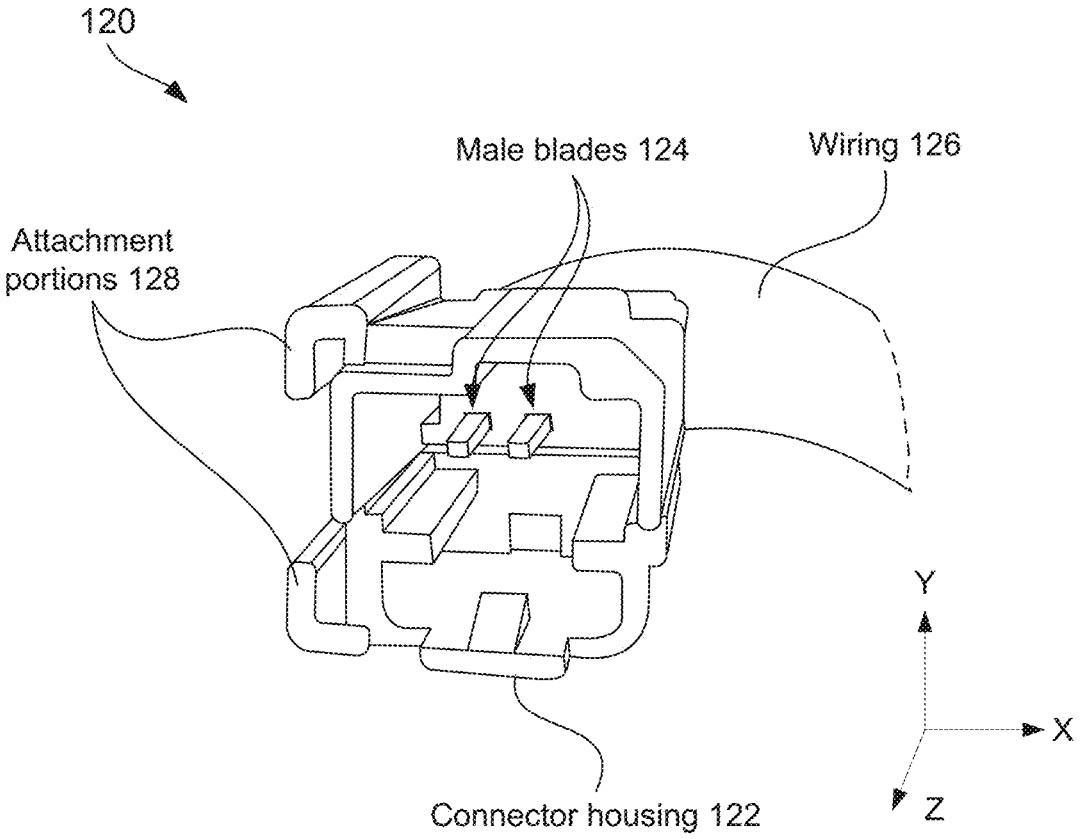
FIG. 1B is an example of a module-side connector, which may terminate wires or attach to a printed circuit board.

As an illustrative example, assembly 100 may comprise speaker system 112 which includes a module-side connector 120. FIG. 1B illustrates an example of a module-side connector, which may terminate wires 126 or be attached to a printed circuit board (PCB). Module-side connector 120 is a male connector which includes male pins or blades 124 within a module-side connector housing 122. Housing 122 may include attachment portions 128 for securing onto a structure, such as door panel. Typically, module-side connector 120 is configured to interface with a circuit-side connector such that blades 124 are inserted into female metal terminals of the circuit-side connector. In existing systems, such female metal terminals would be first coupled to a flex circuit within a circuit-side housing.

As noted above, the need to add metal terminals to flex circuits for mechanically and electrically connecting to a mating metal pin greatly increases weight, size, and costs, which substantially limits the use of various flexible circuits in automotive and other like applications. In some examples, these terminals may not be needed, because the flexible circuit traces of the flex circuit can be designed to be perfectly aligned with the male pins (aka "blades") of a module-side connector.

Described herein are methods and designs which provide the electrical and mechanical attachment of a terminal-free flexible circuit to the male blades of a mating terminal. A specially configured connector housing is used. In some examples, the connector housing is formed from one or more plastic materials described below.

It should be noted that 90% or more of all mating terminals in automotive applications use male blades. As such, the following description focuses on female connectors. However, one having ordinary skill in the art would understand that many described features are also applicable to male connectors, which are also within the scope of this disclosure.

Figure 2A:
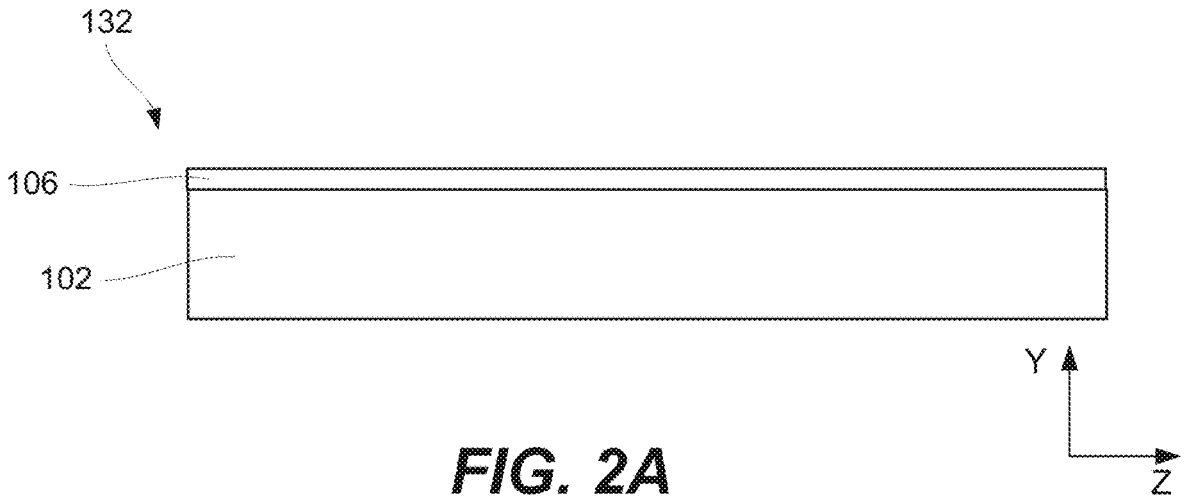
FIGS. 2A, 2B, and 2C are examples of conductive elements for use in signal transmission portions and/or power transmission portions of flexible hybrid interconnect circuits.
Figure 2B:
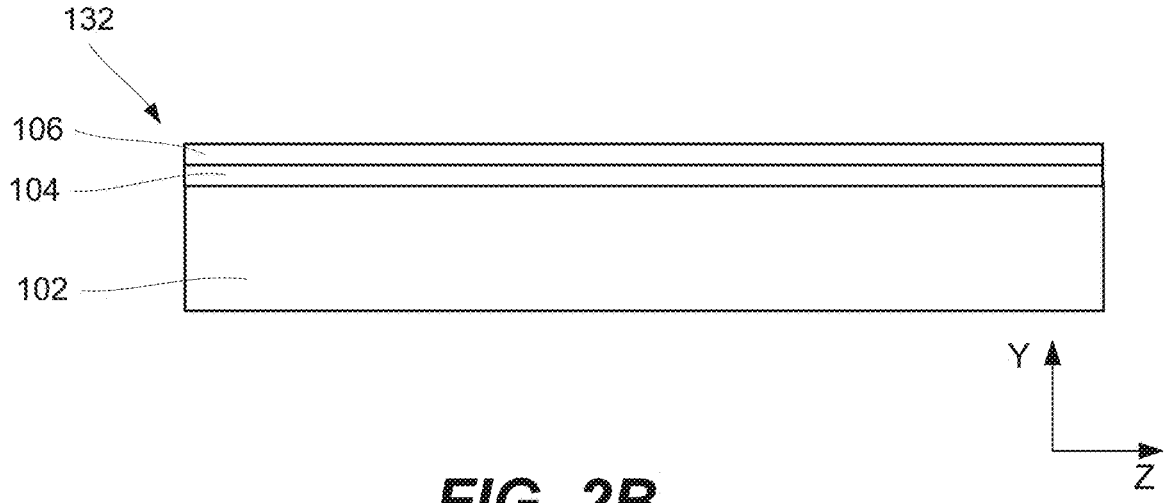
Figure 2C:
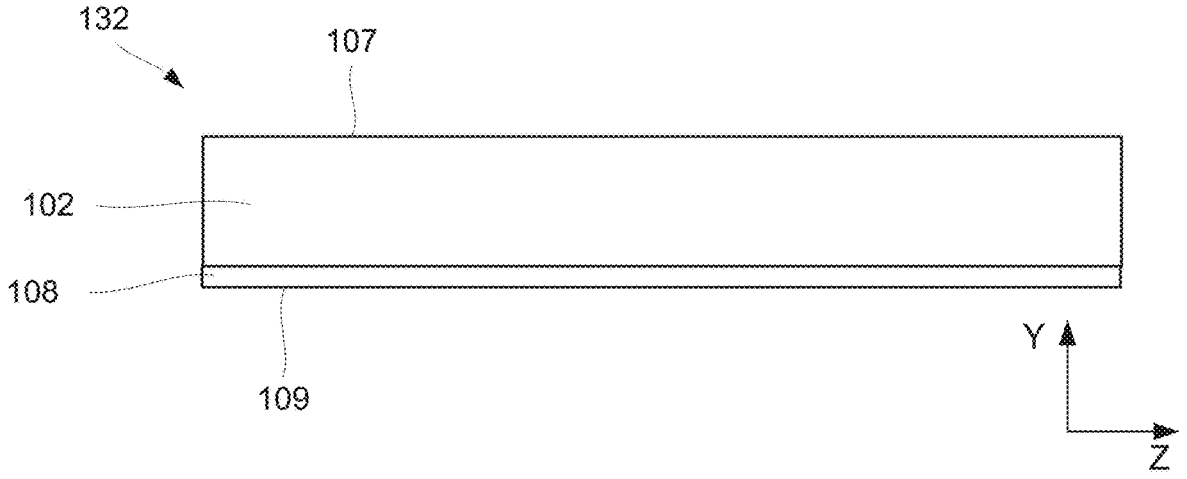

In some examples, one or more conductive elements of flexible hybrid interconnect circuit 100 comprise a base sublayer and a surface sublayer. For example, FIGS. 2A, 2B, and 2C illustrate various examples of signal line 132. However, these examples are also applicable to any other conductive element. The depicted signal line 132 may be a cross-sectional view of a flexible interconnect circuit 100. As shown in FIG. 2A, signal line 132 comprises base sublayer 102 and surface sublayer 106, such that surface sublayer 106 may have a different composition than base sublayer 102. A dielectric may be laminated over surface sublayer 106. More specifically, at least a portion of surface sublayer 106 may directly interface a dielectric (or an adhesive used for attaching these dielectrics). Surface sublayer 106 may be specifically selected to improve adhesion of the dielectric to signal line 132, and/or other purposes as described below.

Base sublayer 102 may comprise a metal selected from a group consisting of aluminum, titanium, nickel, copper, and steel, and alloys comprising these metals. The material of base sublayer 102 may be selected to achieve desired electrical and thermal conductivities of signal line 132 (or another conductive element) while maintaining minimal cost.

Surface sublayer 106 may comprise a metal selected from the group consisting of tin, lead, zinc, nickel, silver, palladium, platinum, gold, indium, tungsten, molybdenum, chrome, copper, alloys thereof, organic solderability preservative (OSP), or other electrically conductive materials. The material of surface sublayer 106 may be selected to protect base sublayer 102 from oxidation, improve surface conductivity when forming electrical and/or thermal contact to device, improve adhesion to signal line 132 (or another conductive element), and/or other purposes. Furthermore, in some examples, the addition of a coating of OSP on top of surface sublayer 106 may help prevent surface sublayer 106 itself from oxidizing over time.

For example, aluminum may be used for base sublayer 102. While aluminum has a good thermal and electrical conductivity, it forms a surface oxide when exposed to air. Aluminum oxide has poor electrical conductivity and may not be desirable at the interface between signal line 132 and other components making an electrical connection to signal line 132. In addition, in the absence of a suitable surface sublayer, achieving good, uniform adhesion between the surface oxide of aluminum and many adhesive layers may be challenging. Therefore, coating aluminum with one of tin, lead, zinc, nickel, silver, palladium, platinum, gold, indium, tungsten, molybdenum, chrome, or copper before aluminum oxide is formed mitigates this problem and allows using aluminum as base sublayer 102 without compromising electrical conductivity or adhesion between signal line 132 (or another conductive element) and other components of flexible hybrid interconnect circuit 100.

Surface sublayer 106 may have a thickness of between about 0.01 micrometers and 10 micrometers or, more specifically, between about 0.1 micrometers and 1 micrometer. For comparison, thickness of base sublayer 102 may be between about 10 micrometers and 1000 micrometers or, more specifically, between about 100 micrometers and 500 micrometers. As such, base sublayer 102 may represent at least about 90% or, more specifically, at least about 95% or even at least about 99% of signal line 132 (or another conductive element) by volume.

While some of surface sublayer 106 may be laminated to an insulator, a portion of surface sublayer 106 may remain exposed. This portion may be used to form electrical and/or thermal contacts between signal line 132 to other components.

In some examples, signal line 132 (or another conductive element) further comprises one or more intermediate sublayers 104 disposed between base sublayer 102 and surface sublayer 106 as, for example, shown in FIG. 2B. Intermediate sublayer 104 has a different composition than base sublayer 102 and surface sublayer 106. In some examples, the one or more intermediate sublayers 104 may help prevent intermetallic formation between base sublayer 102 and surface sublayer 106. For example, intermediate sublayer 104 may comprise a metal selected from a group consisting of chromium, titanium, nickel, vanadium, zinc, and copper.

In some examples, signal line 132 (or another conductive element) may comprise rolled metal foil. In contrast to the vertical grain structure associated with electrodeposited foil and/or plated metal, the horizontally-elongated grain structure of rolled metal foil may help increase the resistance to crack propagation in conductive elements under cyclical loading conditions. This may help increase the fatigue life of flexible hybrid interconnect circuit 100.

In some examples, signal line 132 (or another conductive element) comprises electrically insulating coating 108, which forms surface 109 of signal line 132, disposed opposite of conductive surface 107 as shown, for example, in FIG. 2C. At least a portion of this surface 109 may remain exposed in flexible hybrid interconnect circuit 100 and may be used for heat removal from flexible hybrid interconnect circuit 100. In some examples, the entire surface 109 remains exposed in flexible hybrid interconnect circuit 100. Insulating coating 108 may be selected for relatively high thermal conductivity and relatively high electrical resistivity and may comprise a material selected from a group consisting of silicon dioxide, silicon nitride, anodized alumina, aluminum oxide, boron nitride, aluminum nitride, diamond, and silicon carbide. Alternatively, insulating coating may comprise a composite material such as a polymer matrix loaded with thermally conductive, electrically insulating inorganic particles.

In some examples, a conductive element is solderable. When a conductive element includes aluminum, the aluminum may be positioned as base sublayer 102, while surface sublayer 106 may be made from a material having a melting temperature that is above the melting temperature of the solder. Otherwise, if surface sublayer 106 melts during circuit bonding, oxygen may penetrate through surface sublayer 106 and oxidize aluminum within base sublayer 102. This in turn may reduce the conductivity at the interface of the two sublayers and potentially cause a loss of mechanical adhesion. Hence, for many solders that are applied at temperatures ranging from 150-300° C., surface sublayer 106 may be formed from zinc, silver, palladium, platinum, copper, nickel, chrome, tungsten, molybdenum, or gold. In some examples, e.g., in cases in which a high frequency signal is to be transmitted down the signal line, the surface sublayer composition and thickness may be chosen in order minimize resistance losses due to the skin effect.

Circuit-Side Connector Examples

Figure 3B:
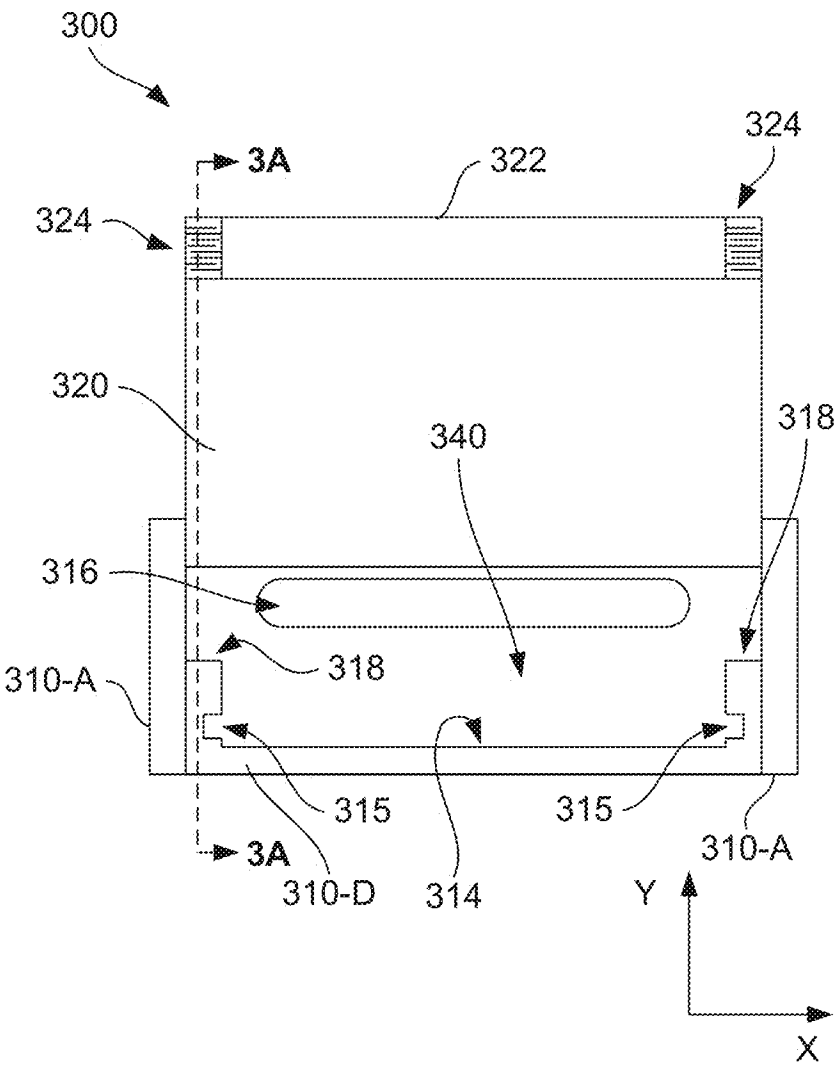
FIGS. 3A, 3B, 3C, 3D, 3E, 3F, 3G, and 3H illustrate various cross-sectional views of a circuit-side connector, in accordance with one or more embodiments.
Figure 3A:
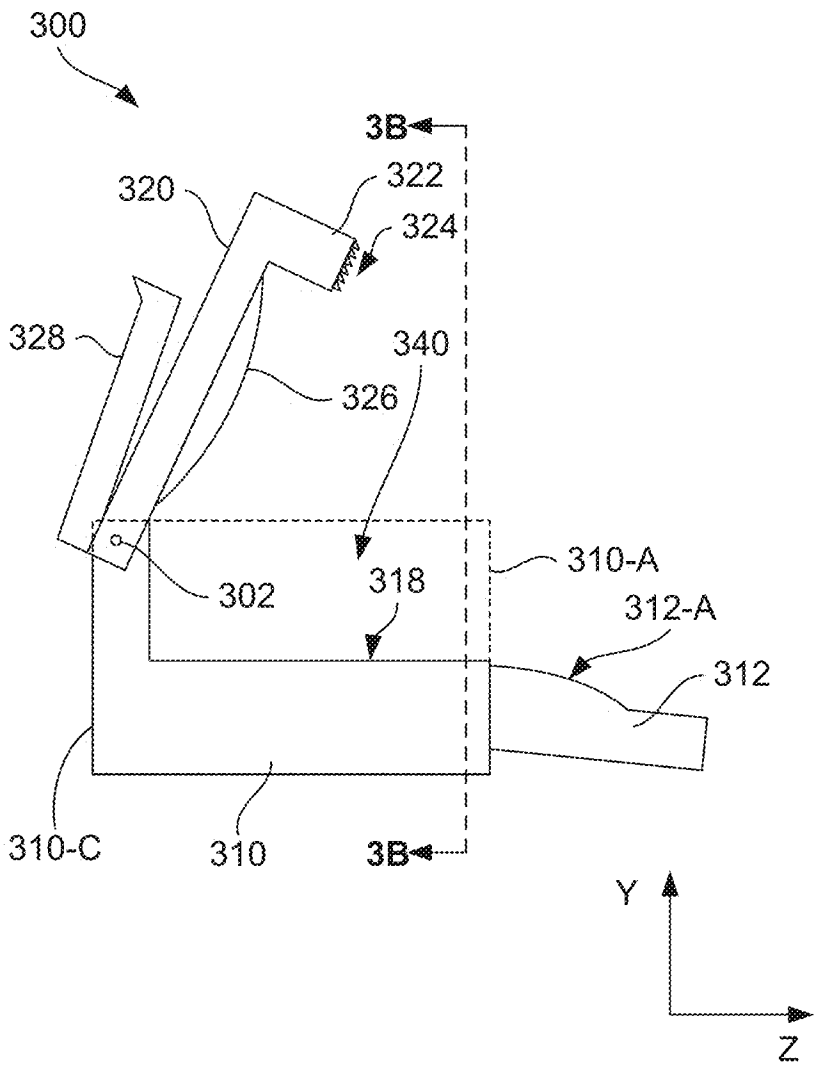
Figure 3C:
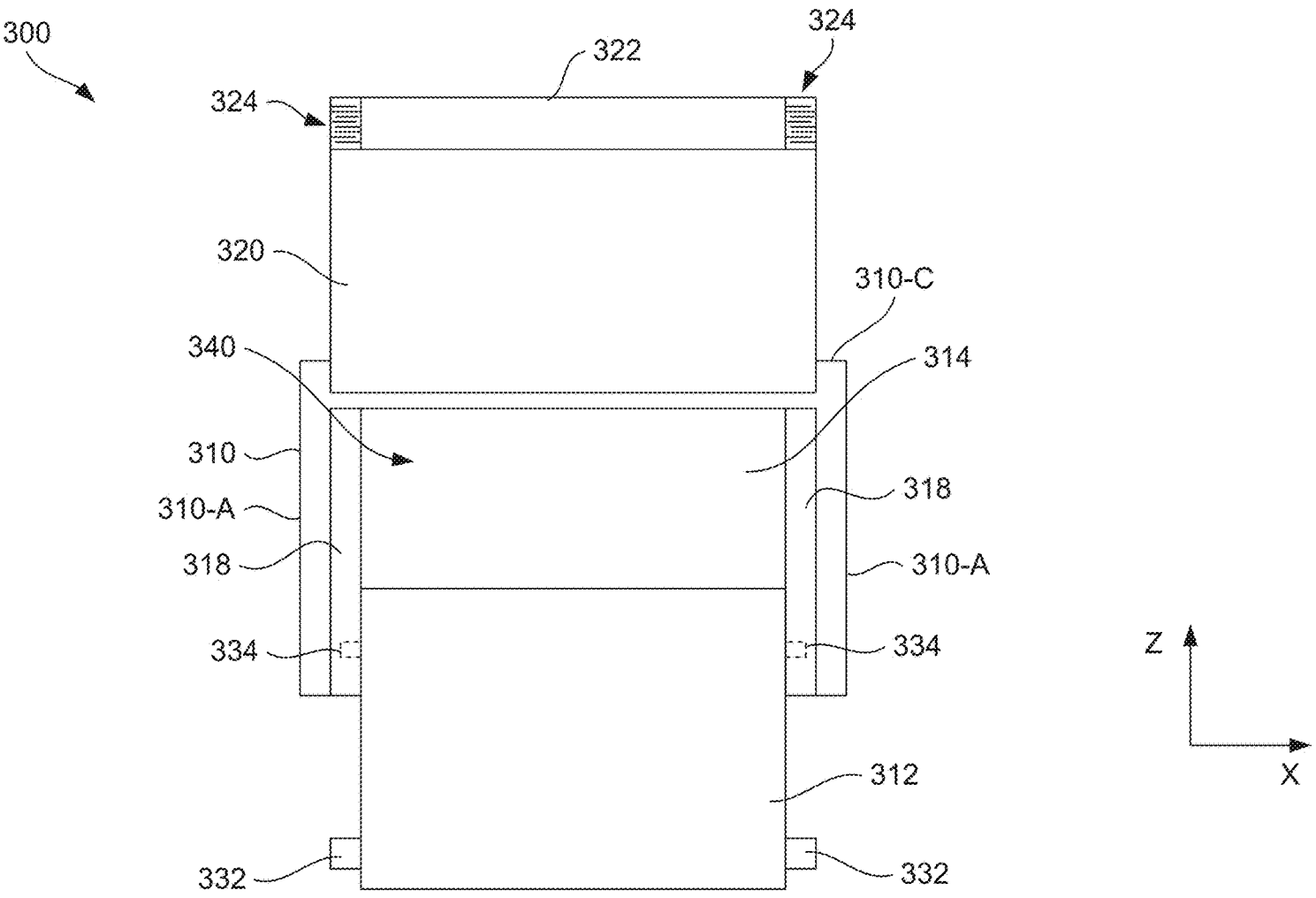

FIGS. 3A, 3B, 3C, 3D, 3E, 3F, 3G, and 3H illustrate various cross-sectional views of a circuit-side connector 300, in accordance with one or more embodiments. FIG. 3A shows a side view cross-section of connector 300 in an open and unloaded configuration from the 3A-3A viewpoint shown in FIG. 3B. FIG. 3B shows a back view of connector 300 in the open and unloaded configuration from the 3B-3B viewpoint shown in FIG. 3A. FIG. 3C is a top-down view of connector 300 in the open and unloaded configuration.

Specifically, connector 300 is configured with a hinge, which may be a ball-in-socket design or may simply be a region of thin, flexible plastic. The hinge allows the flex circuit to be more easily pre-loaded into the connector. In various embodiments, connector 300 comprises base 310 coupled to upper piece 320 via hinge 302. As used herein, the upper piece may be referred to as a cover piece. In some embodiments, hinge 302 may be any one of various mechanical hinge structures allowing upper piece 320 to pivot about a rotation axis centered upon hinge 302. For example, hinge 302 may be a mechanical bearing. As another example, hinge 302 may be a living hinge made from the same material as the rigid base 310 and upper piece 320. As such, base 310 and upper piece 320 may comprise a single monolithic structure.

Base 310 may be configured with blade opening 316 through which a male blade of a module-side connector may be inserted. In some embodiments, blade opening 316 may comprise a single continuous opening which allows multiple blades to pass through. In some embodiments, base 310 may include multiple blade openings, such as blade openings 316-A shown in FIG. 3E, with each blade opening 316-A corresponding to a separate male blade of the module-side connector. Blade opening or openings 316 are located on forward wall 310-C.

Base 310 may further comprise side walls 310-A (shown in dashed lines in FIG. 3A) and edge supports 318, which define a housing chamber 340 along with the floor or bottom wall 310-D of base 310. Housing chamber 340 may comprise slider track 314 positioned between edge supports 318 in which slider 312 is positioned. In some embodiments, slider 312 may include a convex upper surface 312-A. Slider 312 is not shown in FIG. 3B for visual clarity.

In some embodiments, each edge support 318 may further comprise a slider guide 315 for guiding the movement and position of slider 312. Each slider guide 315 may be a track or indented space within a corresponding edge support or base wall. In some embodiments, each slider guide 315 may be raised from the floor 310-D of based 310 as shown in FIG. 3B. However, in some embodiments, the bottom of each slider guide 315 may be flush with the floor of slider track 314. In various embodiments, protrusions 334 are positioned on each side of slider 312 (shown in FIG. 3C) and each protrusions 334 may travel within a corresponding slider guide 315. In some embodiments, slider 312 also includes one or more latches 332 for securing the slider in an inserted position (also shown in FIG. 3C).

Upper piece 320 may further comprise one or more of clamp portion 322, contact surface 326, and latch 328. Clamp portion 322 may further include grip surfaces 324 aligned with edge supports 318. In various embodiments, grip surfaces 324 may include raised, scored, or serrated structures, or may comprise various materials (such as rubber), which increase the traction or friction between the clamp portion and an opposite surface contacting the grip surfaces with applied pressure. The describe structures are configured to secure a pre-loaded flex circuit within circuit-side connector 300, as will be further explained below.

Figure 3E:
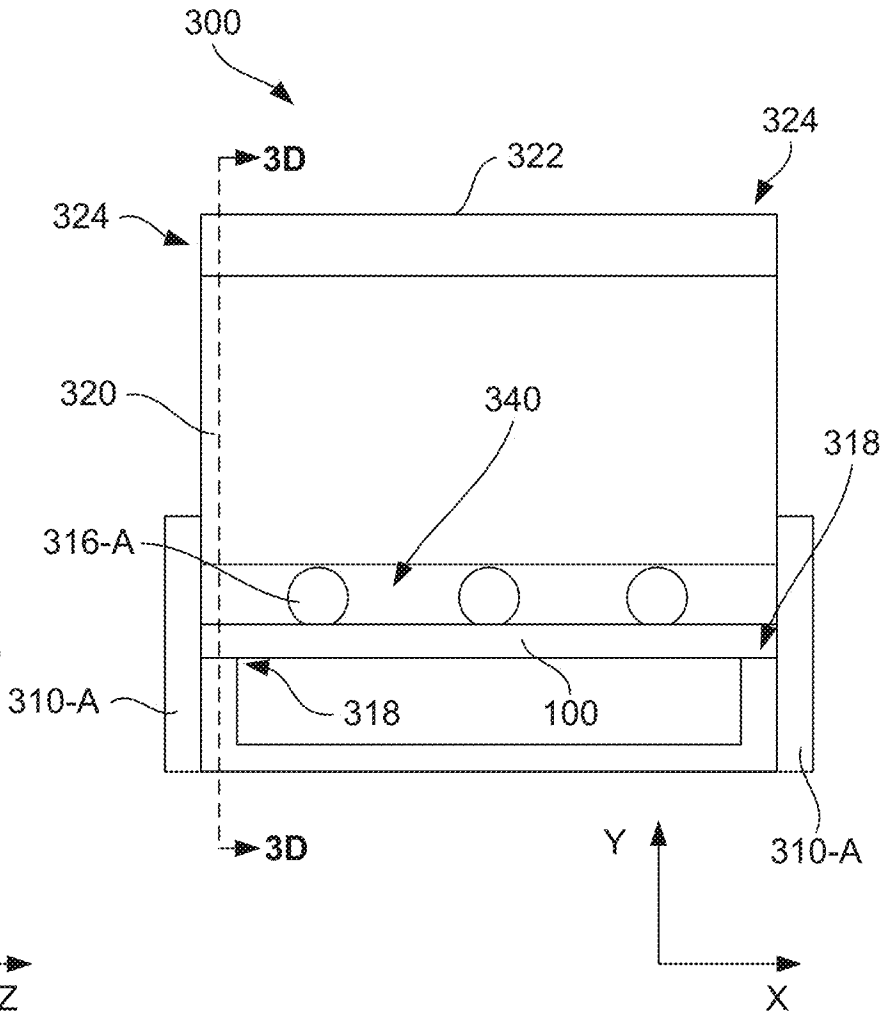
Figure 3D:
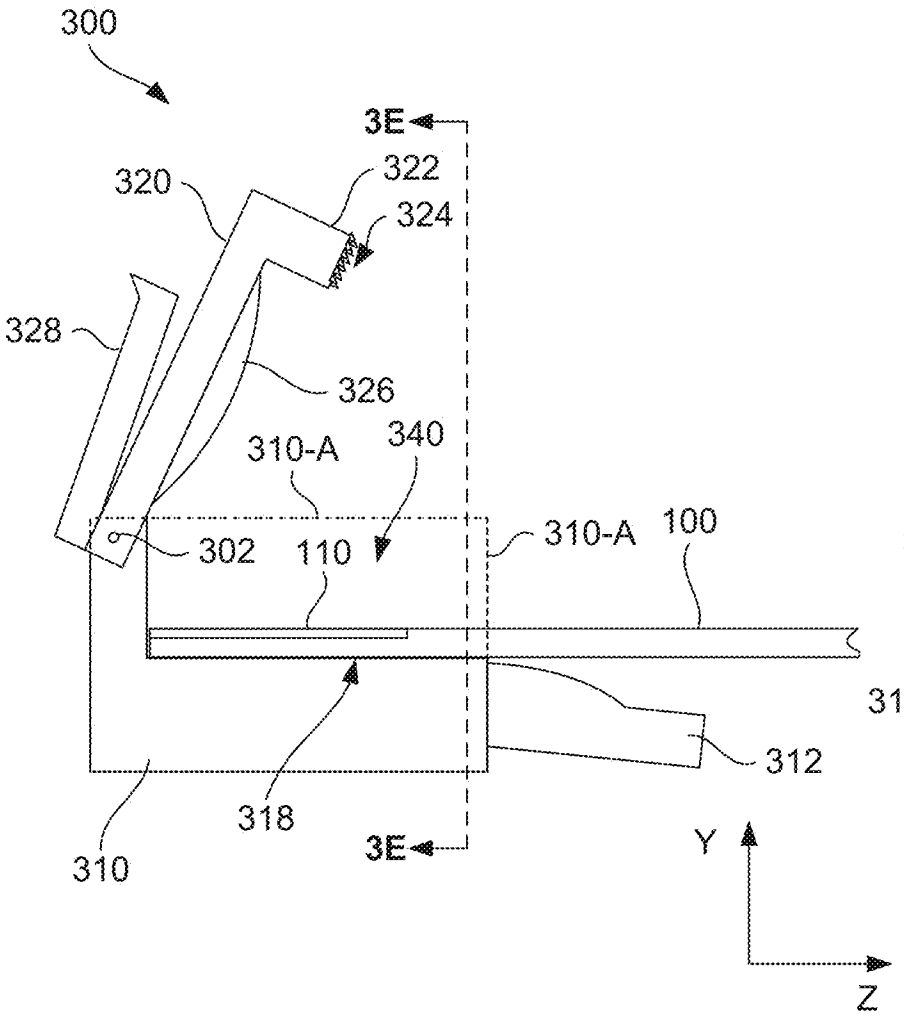
Figure 3F:
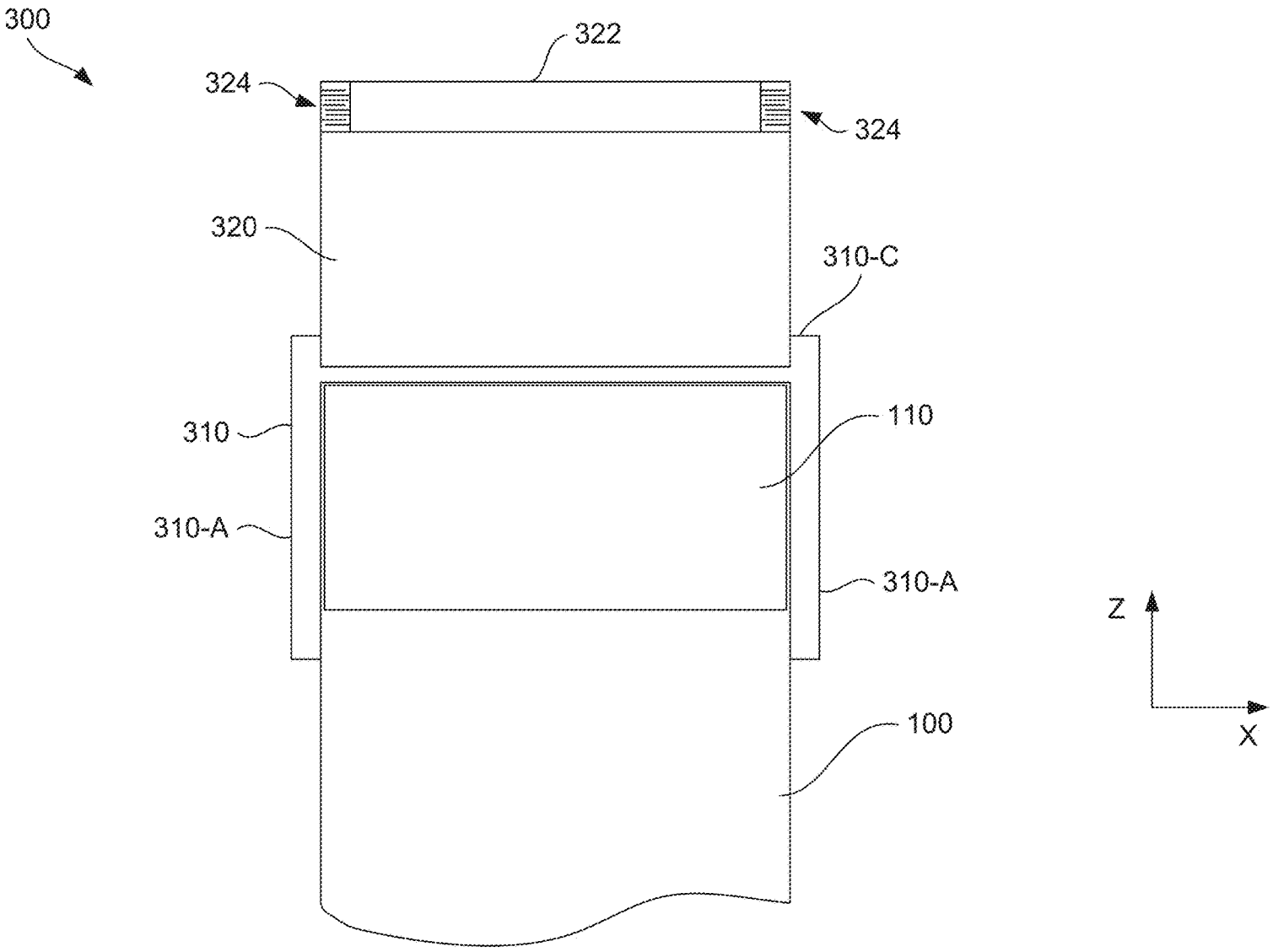

Edge supports 318 may be built into the connector and allow for the precise placement of the flex circuit 100 inside the connector. FIG. 3D shows a side view cross-section of connector 300 in an open and pre-loaded configuration from the 3D-3D viewpoint shown in FIG. 3E. FIG. 3E shows a back view of connector 300 in the open and pre-loaded configuration from the 3E-3E viewpoint shown in FIG. 3D. FIG. 3F is a top-down view of connector 300 in the open and pre-loaded configuration. As depicted in FIGS. 3D, 3E, and 3F, flex circuit 100 is positioned within housing chamber 340 upon edge supports 318. In some embodiments, side walls 310-A and edge supports 318 are sized accordingly with respect to the width of flex circuit 100 to allow precise placement of flex circuit 100 within housing chamber 340.

Figure 3H:
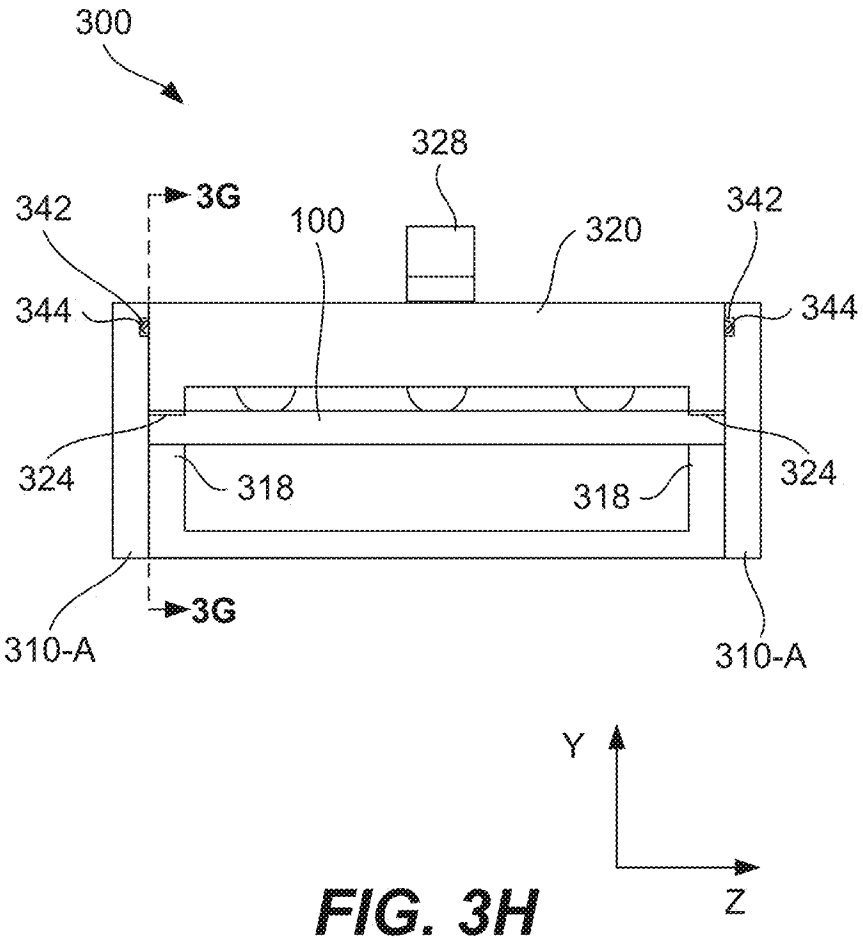
Figure 3G:
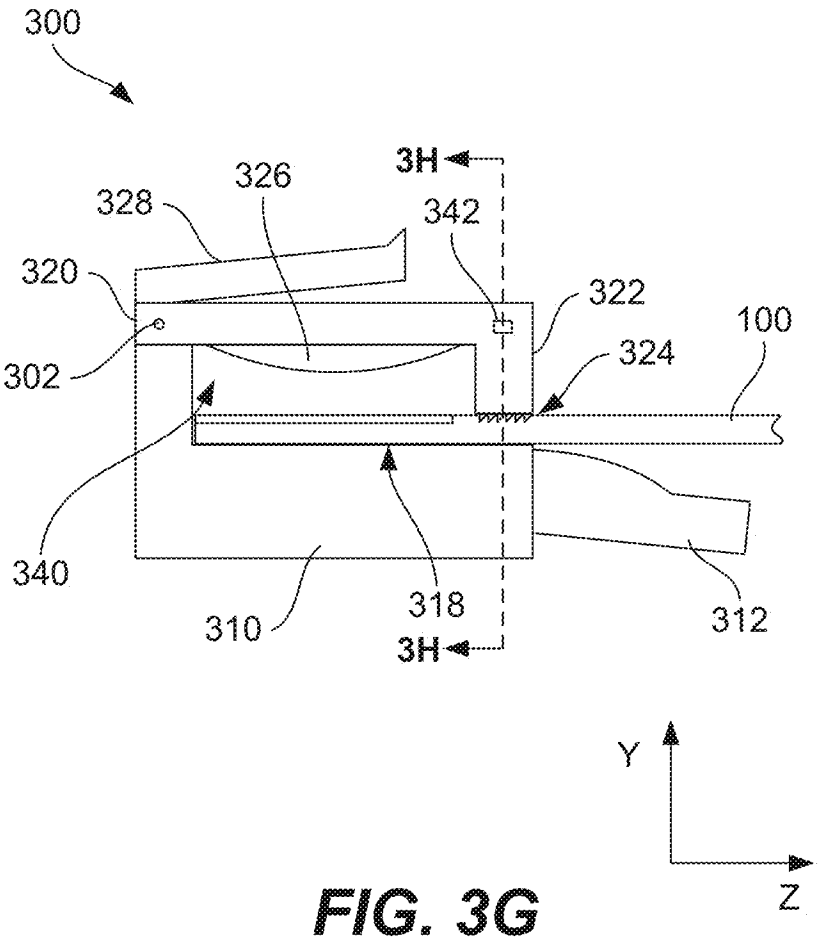

In some examples, the flex circuit may be backed with pressure sensitive adhesive (PSA) at the bottom surface to allow the flex circuit to be tacked to the connector at the edge supports. In some embodiments, flex circuit 100 may be configured with a conductive surface 110, such as described with reference to base sublayer 106. In some embodiments, the conductive surface of the flex circuit may be exposed copper or gold. Once flex circuit 100 has been pre-loaded, upper piece 320 may be placed into a closed position to cover housing chamber 340 and secure the flex circuit within. FIG. 3G shows a side-view cross-section of circuit-side connector 300 in a fully pre-loaded configuration from the 3G-3G viewpoint. FIG. 3H shows a back view of connector 300 in the fully pre-loaded configuration from the 3H-3H viewpoint. As shown, in the closed position, clamp portion 322 contacts flex circuit 100 and urges flex circuit 100 against edge supports 318 of base 310. This is a first securing function of the described systems.

In some embodiments, the configuration of grip surfaces 324 may apply additional force against flex circuit 100. In some embodiments, grip surfaces 324 may comprise a rough surface with a high friction coefficient. In some embodiments, the grip surfaces may include various types of corrugated or grooved surfaces. For example, the grip surfaces may include rounded ridges. In some embodiments, the grip surfaces may include sharp ridges. In some embodiments, the ridges may be angled inward toward the interior of housing chamber 340 to apply additional friction against flex circuit 100 and prevent slippage of the flex circuit out of the connector. In certain examples, sharp ridges may be configured to partially or fully puncture flex circuit to apply additional friction against flex circuit 100. The ridges may be configured with various other geometries known to prevent slippage of the flex circuit in a direction outward from the connector. In some embodiments, the grip surfaces may include materials that increase frictional interaction with the contact portion of the flex circuit. For example, grip surfaces may include rubber material. In certain embodiments, the material may depend on the material of the flex circuit. For example, a grip surface may include aluminum material to contact a flex circuit comprising aluminum to create a high coefficient of friction.

In some embodiments, upper piece 320 may include one or more protrusions 342 on each side (shown in FIGS. 3G and 3H). Protrusions 342 may be configured to fit within corresponding slots 344 within side walls 310-A. For example, as upper piece 320 is placed into the closed position, protrusions 342 may cause side walls 310-A to expand outward laterally until each protrusion is aligned and positioned within corresponding slots 344. This configuration may secure upper piece 320 in the closed position.

Alternatively, and/or additionally, latch 328 may be configured to secure upper piece 320 in the closed position. For example, latch 328 may be configured as a cam lever such as a spiral cam lever which may comprise an eccentric lever that moves along a logarithmic spiral. When rotating about a center axis, the hip cam levers may transform the rotary motion into linear motion against the upper piece in the downward direction.

Once the circuit-side connector is fully pre-loaded within the circuit-side connector housing, it may be interfaced with a module-side connector to electrically link the flex circuit with male connector blades of the module-side connector. FIGS. 4A, 4B, 4C, 4D, and 4E illustrate various cross-sectional views of a circuit-side connector 300 interfacing with a module-side connector 420, in accordance with one or more embodiments. In various embodiments, module-side connector 420 may be module-side connector 120, comprising a module-side connector housing 422 and one or more male blades 424. Male blades 424 may terminate wiring or circuitry, or may be attached to a printed circuit board. Such wiring 424-A is shown in dashed lines or omitted for clarity in the following figures.

Figure 4A:
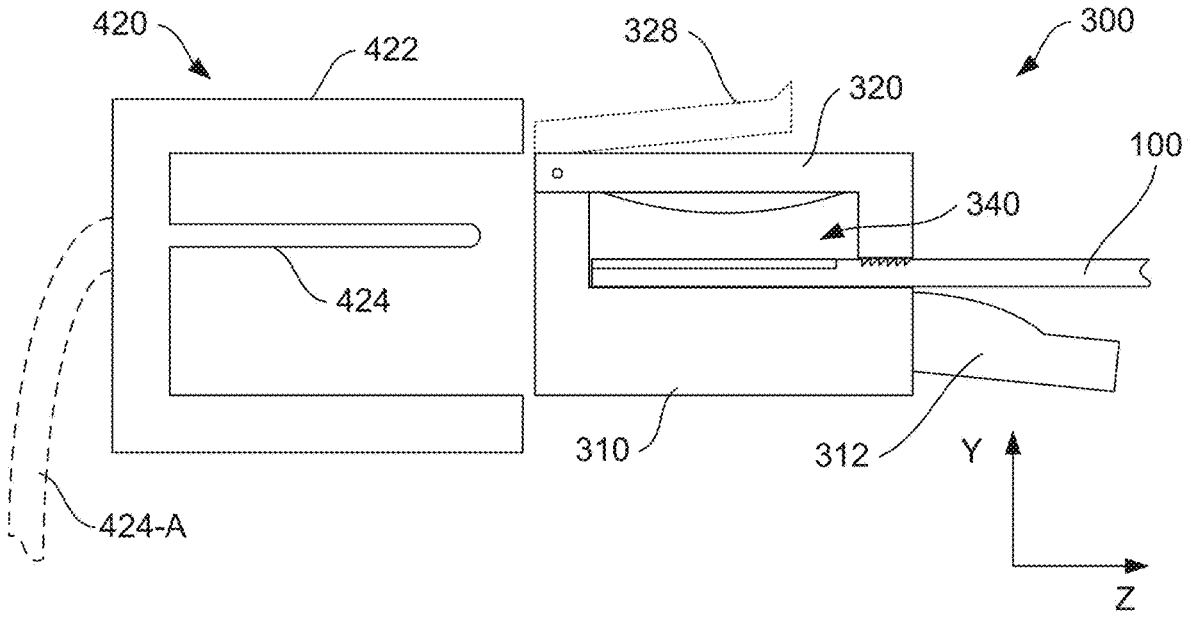
FIGS. 4A, 4B, 4C, and 4D illustrate various cross-sectional views of the circuit-side connector of FIGS. 3A-3H interfacing with a module-side connector, in accordance with one or more embodiments.
Figure 4B:
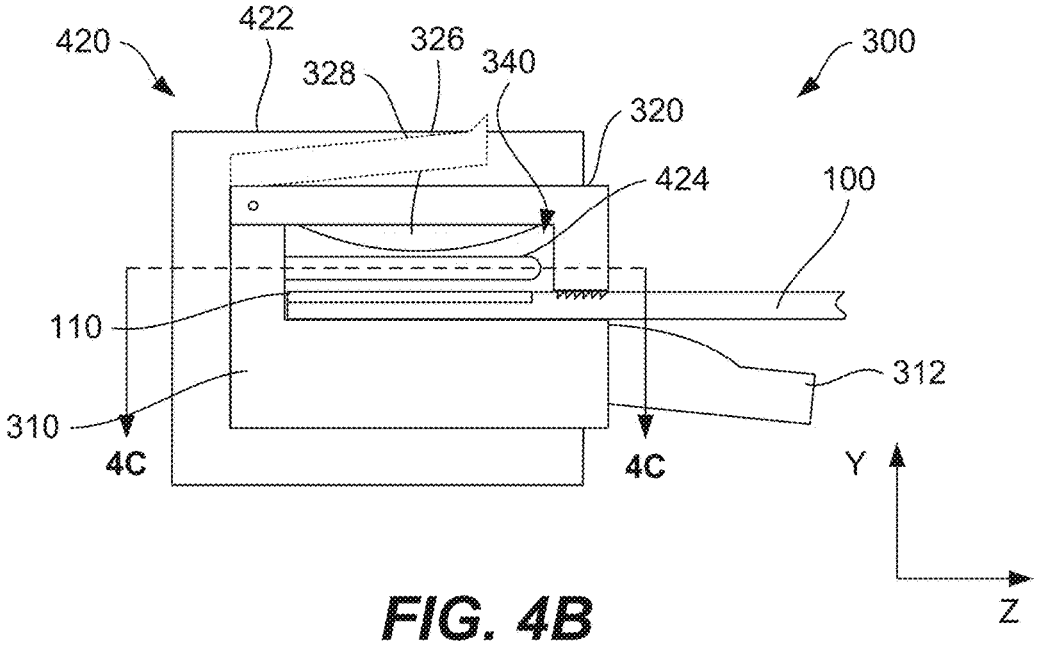

FIG. 4A shows a side view cross-section of the module-side connector 420 and circuit-side connector 300 prior to insertion. Circuit-side connector may be configured to be inserted into module-side connector housing 420, and blades 424 may be configured to be aligned with and inserted through the corresponding blade opening or openings of base 310. FIG. 4B shows a side view cross-section of circuit-side connector 300 inserted within module-side connector 420. FIG. 4C shows a top-down cross-section view of circuit-side connector 300 inserted within module-side connector 420 from the C-C viewpoint in FIG. 4B.

In some embodiments, latch 328 may be configured to secure circuit-side connector 300 within module-side connector 420. This is a second securing function of the described systems. In some embodiments, latch 328 may be configured to be drop-in compatible with existing module-side connector housing designs. However, in some embodiments, additional and/or alternative securing mechanisms may be positioned external to both connector housings. In some embodiments, insertion of the circuit-side connector into module-side connector housing 422 may further urge upper piece 320 against flex circuit 100 and edge supports 318. Once inserted, blades 424 are aligned with conductive surface 110 of the flex circuit.

At this point, blades 424 may already be sufficiently electrically coupled to the conductive surface 110 of the flex circuit. In some embodiments, contact surface 326 may include a convex geometry which urges the inserted male blades downward against the conductive surface 110 of the flex circuit. In some embodiments, slider 312 may then be inserted into housing chamber 340 to ensure or further secure the electrical coupling between blades 424 and conductive surface 110 of flex circuit 100. However, in some embodiments, contact surface 326 may not contact blades 424 until slider 312 is placed in the inserted position. In some embodiments, no electrical coupling is formed between blades 424 and conductive surface 110 until slider 312 is inserted.

Figure 4D:
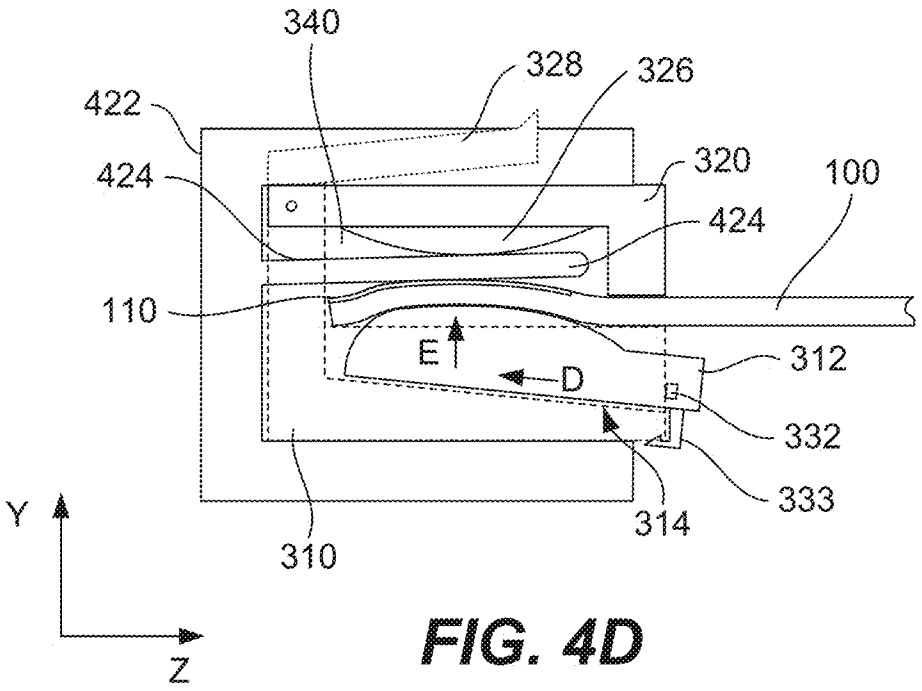
Figure 4C:
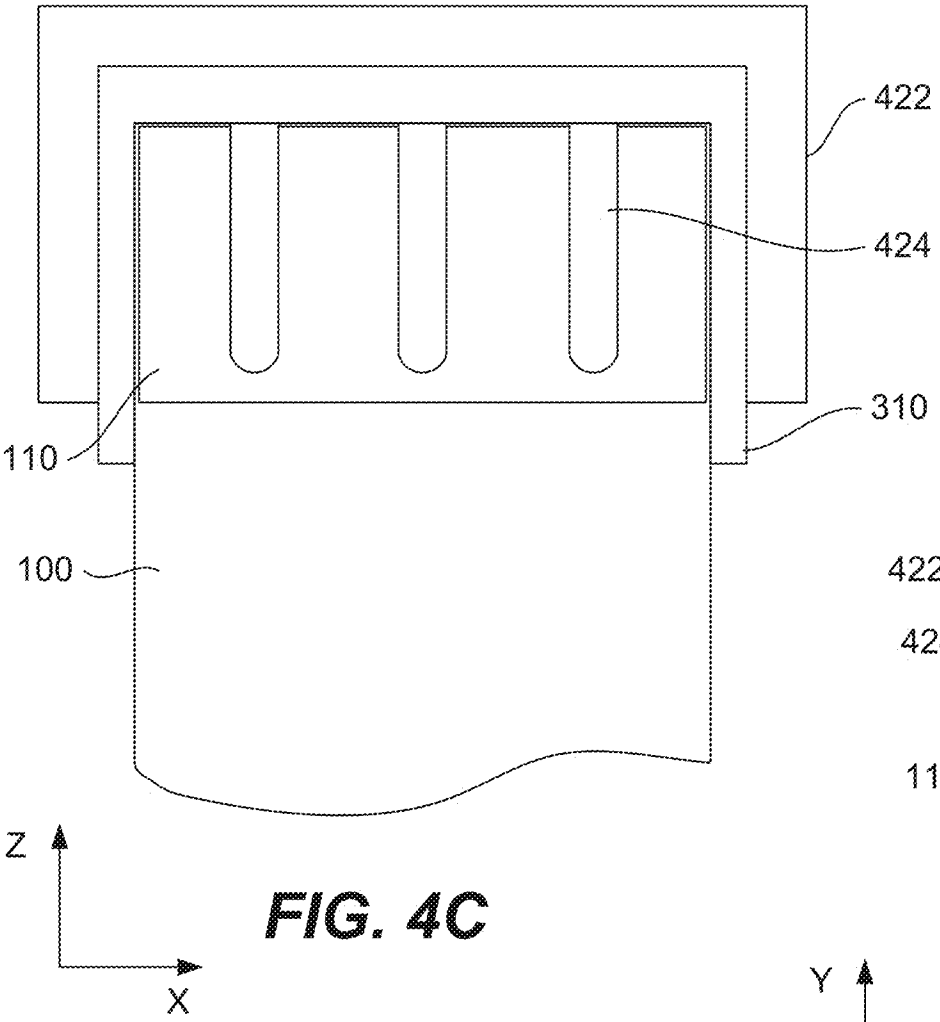

FIG. 4D shows slider 312 in an inserted position. As depicted, in some embodiments, slider track 314 may include an inclined surface causing slider 312 to shift upward as it is inserted into housing chamber 340 in the direction of arrow D. This may cause the upper surface of slider 312 to urge flex circuit upward in the direction of arrow E against blades 424 causing electrical contact between blades 424 and conductive surface 110. The wedge shape of slider 312 may ensure high contact force between the flex circuit and the blades. This is a third securing function of the described systems. In some embodiments, the floor of slider track 314 may be flat and the system relies only on the wedge shape of the slider to urge the flex circuit and males blades together.

In some embodiments, this movement may also cause blades 424 to be slightly urged upward. In various embodiments, contact surface 326 of upper piece 320 is configured to contact blades 424 in order to support blades 424 against the upward movement of slider 312 and flex circuit 100, further supporting electrical contact between the blades and flex circuit. In some embodiments, flex circuit 100 may remain adhered to or in contact with edge supports 318 once slider 312 has been inserted. However, insertion of slider 312 may cause portions of the flex circuit to detach from edge supports 318.

In various embodiments, slider 312 may include latches 332 (shown in FIG. 4D) which may be configured to secure slider 312 against base 310 in the inserted position. In some embodiments, slider 312 may additionally, or alternatively, include a latch or clip 333 as a mechanism for securing slider 312 against base 310 in the inserted position. It should be understood by one of ordinary skill in the art that the various embodiments of circuit-side connectors and module-side connectors may include all or fewer features and components described herein.

Figure 4E:
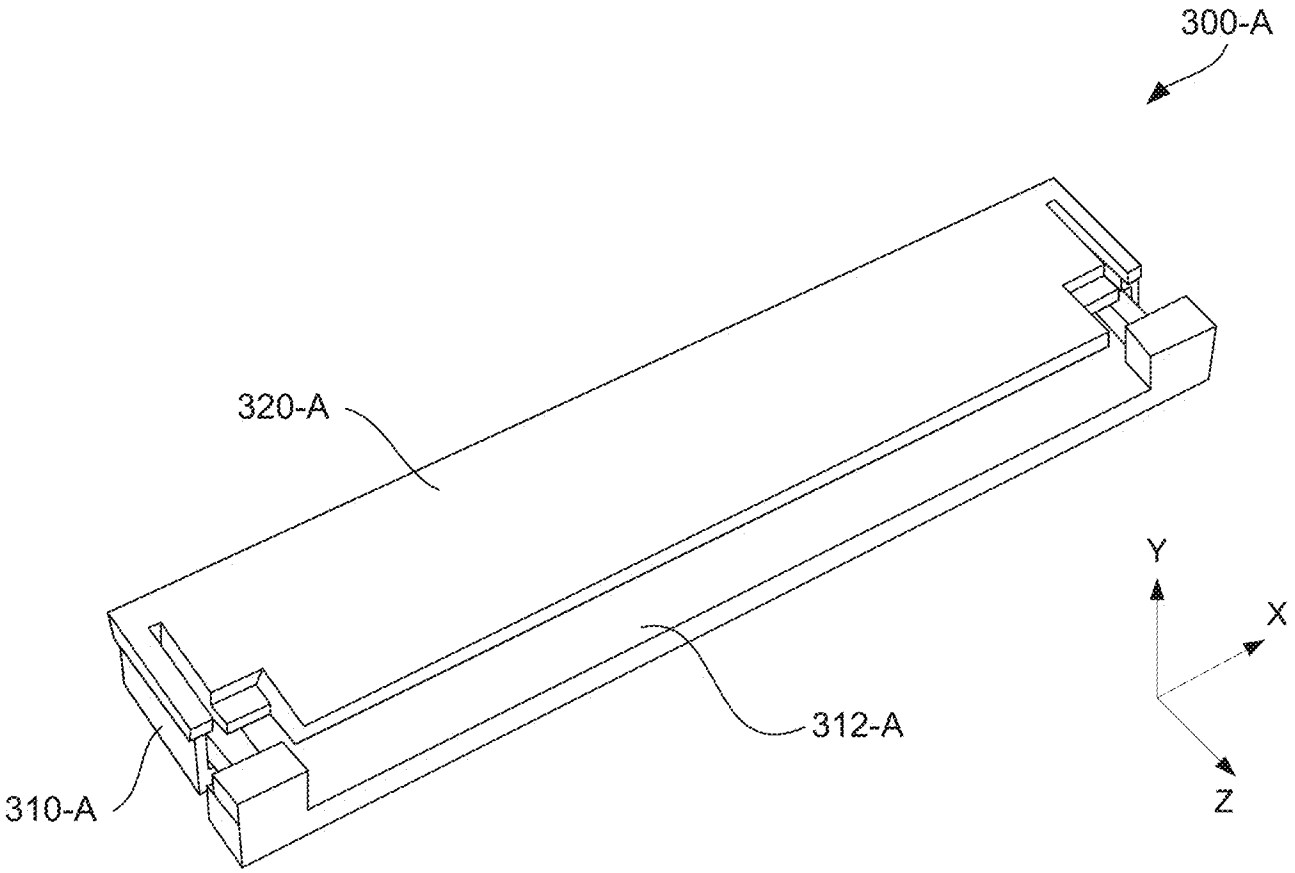
FIG. 4E is an example of a circuit-side connector housing with slider bar used for zero insertion force (ZIF) terminals, in accordance with one or more embodiments.

FIG. 4E illustrates a perspective view of another example of a circuit-side connector 300-A with a slider 312-A used for zero insertion force (ZIF) terminals, in accordance with one or more embodiments. Connector 300-A further includes base 310-A and upper portion 320-A, which may include any one or more of the features previously described with reference to connector 300. Other designs used to accomplish the three securing functions are also within the scope. It should be noted that the three securing functions themselves to be universal. For example, 3D printing may be used to adapt the shape of the female connector housing to any male connector housing.

In some examples, one or more conductive elements of flexible interconnect circuit 100 comprise a base sublayer and a surface sublayer, such that the surface sublayer has a different composition than the base sublayer. Dielectrics may be laminated over the surface sublayer. More specifically, at least a portion of the surface sublayer may directly interface the dielectric. The surface sublayer may be specifically selected to improve adhesion of dielectrics.

The base sublayer may comprise a metal selected from a group consisting of aluminum, titanium, nickel, copper, and steel, and alloys comprising these metals. The material of the base sublayer may be selected to achieve desired electrical and thermal conductivities of conductive lines (e.g., power lines and/or signal lines) while maintaining minimal cost.

The surface sublayer may comprise a metal selected from the group consisting of tin, lead, zinc, nickel, silver, palladium, platinum, gold, indium, tungsten, molybdenum, chrome, copper, alloys thereof, organic solderability preservative (OSP), or other electrically conductive materials. The material of the surface sublayer may be selected to protect the base sublayer from oxidation, improve surface conductivity when forming electrical and/or thermal contact to device, improve adhesion to conductive lines (or another conductive element), and/or other purposes.

For example, aluminum may be used for the base sublayer. While aluminum has a good thermal and electrical conductivity, it forms a surface oxide when exposed to air. Aluminum oxide has poor electrical conductivity and may not be desirable at the interface between conductive lines and other components making an electrical connection to conductive lines. In addition, in the absence of a suitable surface sublayer, achieving good, uniform adhesion between the surface oxide of aluminum and many adhesive layers may be challenging. Therefore, coating aluminum with one of tin, lead, zinc, nickel, silver, palladium, platinum, gold, indium, tungsten, molybdenum, chrome, or copper before aluminum oxide is formed mitigates this problem and allows using aluminum as the base sublayer without compromising electrical conductivity or adhesion between the conductive lines (or another conductive element) and other components of flexible hybrid interconnect circuit 100.

In some examples, conductive lines (or another conductive element) comprise an electrically insulating coating, which forms the surface of the conductive lines. At least a portion of this surface may remain exposed in flexible hybrid interconnect circuit 100 and may be used for heat removal from flexible hybrid interconnect circuit 100. In some examples, the entire surface remains exposed in flexible hybrid interconnect circuit 100. The insulating coating may be selected for relatively high thermal conductivity and relatively high electrical resistivity and may comprise a material selected from a group consisting of silicon dioxide, silicon nitride, anodized alumina, aluminum oxide, boron nitride, aluminum nitride, diamond, and silicon carbide. Alternatively, insulating coating may comprise a composite material such as a polymer matrix loaded with thermally conductive, electrically insulating inorganic particles.

In some examples, flexible interconnect circuit comprises one or more dielectrics, e.g., formed from one or more materials having a dielectric constant less than 2 or even less than 1.5. In some examples, these materials are closed cell foams. In the same or other examples, the material is dielectric crosslinked polyethylene (XLPE) or, more specifically, highly crosslinked XLPE, in which the degree of cross-linking is at least about 40%, at least about 70%, or even at least about 80%. Crosslinking prevents flowing/movement of dielectrics within the operating temperature range of flexible hybrid interconnect circuit 100, which may be between about −40° C. (−40° F.) to +105° C. (+220° F.). Conventional flexible circuits do not use XLPE primarily because of various difficulties with patterning conductive elements (by etching) against the backing formed from XLPE. XLPE is not sufficiently robust to withstand conventional etching techniques. Other suitable materials include polyethylene terephthalate (PET), polyimide (PI), or polyethylene naphthalate (PEN). In some examples, an adhesive material is a part of the dielectric, such as XDPE, low-density polyethylene (LDPE), polyester (PET), acrylic, ethyl vinyl acetate (EVA), epoxy, pressure sensitive adhesives, or the like.

Figure 5A:
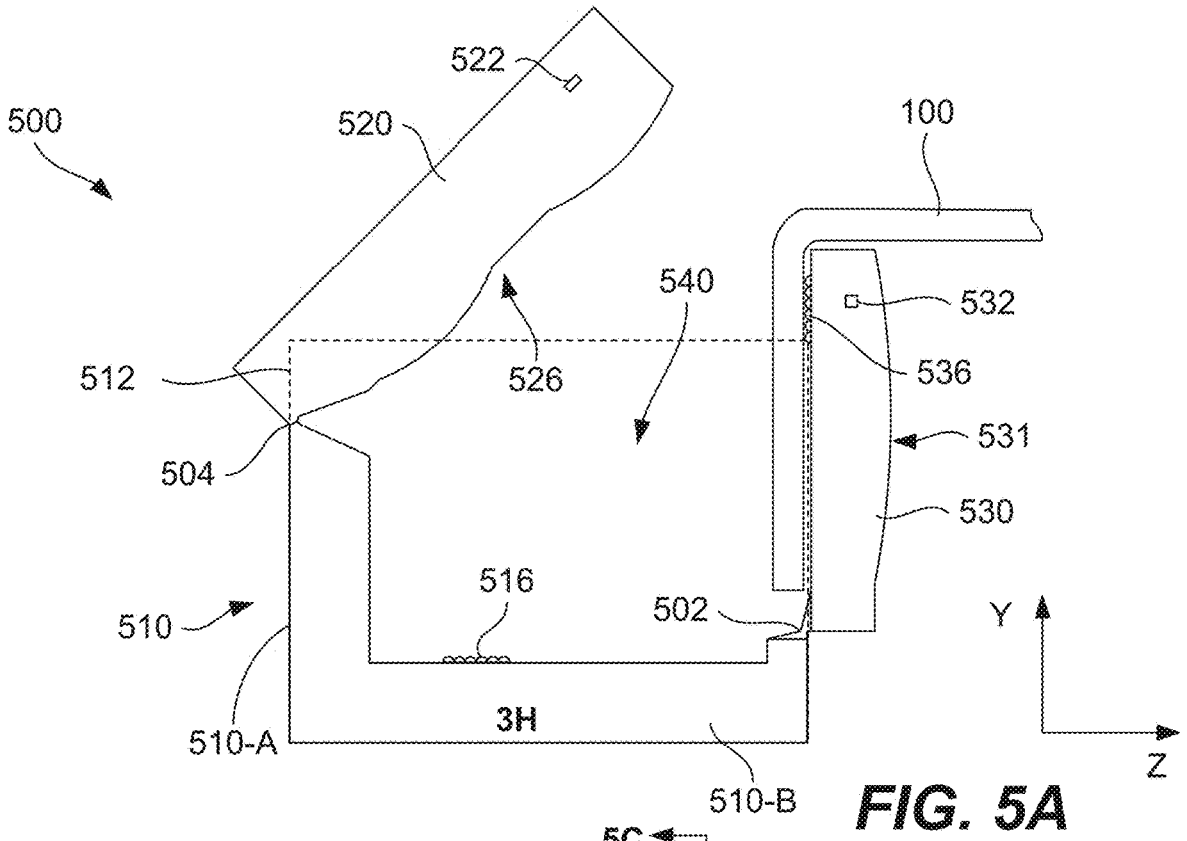
FIGS. 5A, 5B, 5C, 5D, 5E, and 5F illustrate various cross-sectional views of a multi-hinged circuit-side connector, in accordance with one or more embodiments.

In certain embodiments of a circuit-side connector, additional components of the housing structure may be hinged to allow more convenient pre-loading of a flex circuit. FIG. 5A, 5B, 5C, 5D, 5E, and 5F illustrate various cross-sectional views of a multi-hinged circuit-side connector 500, in accordance with one or more embodiments. In particular, FIG. 5A shows a cross-sectional side view of circuit-side connector 500 in a first configuration, or open configuration. In various embodiments, connector 500 comprises a housing with base 510, cover piece 520, and circuit clamp 530. Base 510 comprises two side walls 512 on opposite sides defining housing chamber 540 along with forward interface surface or wall 510-A and the floor or bottom wall 510-B of the base. Base 510 may further include blade opening 514 in forward wall 510-A (shown in FIG. 5C), and grip surface 516 on the interior surface of bottom wall 510-B. Cover piece 520 may comprise protrusions 522 and contact surface 526. Circuit clamp 530, or clamp piece, may comprise protrusions 532 and grip surface 536.

In various embodiments, base 510 is coupled to cover piece 520 and circuit clamp 530 via hinge 504 and hinge 502, respectively. In various embodiments hinges 502 and 504 may be any one of various mechanical hinge structures allowing the pieces to move about the respective hinge with respect to base 510. As depicted, hinges 502 and 504 are living hinges comprising the same material as base 510, cover piece 520, and circuit clamp 530. In some embodiments, base 510, cover piece 520, and circuit clamp 530 may be a single monolithic structure. However, other types of hinges may be implemented, such as ball bearing hinges, barrel hinges, butt hinges, piano hinges, leaf hinges, and others.

In the first (open) configuration, a flex circuit 100 may be positioned against the interior surface of the circuit clamp facing the housing chamber (as shown in FIG. 5A). As shown, the clamp piece is positioned with respect to the base at approximately 90 degrees. However, in some embodiments, hinge 502 may be configured to allow the clamp piece to open up to greater angles in order to provide increased access for the flex circuit. As previously described, the flex circuit may be PSA backed to allow the circuit to be tacked into the desired position on the inner surface of the clamp piece.

Figure 5B:
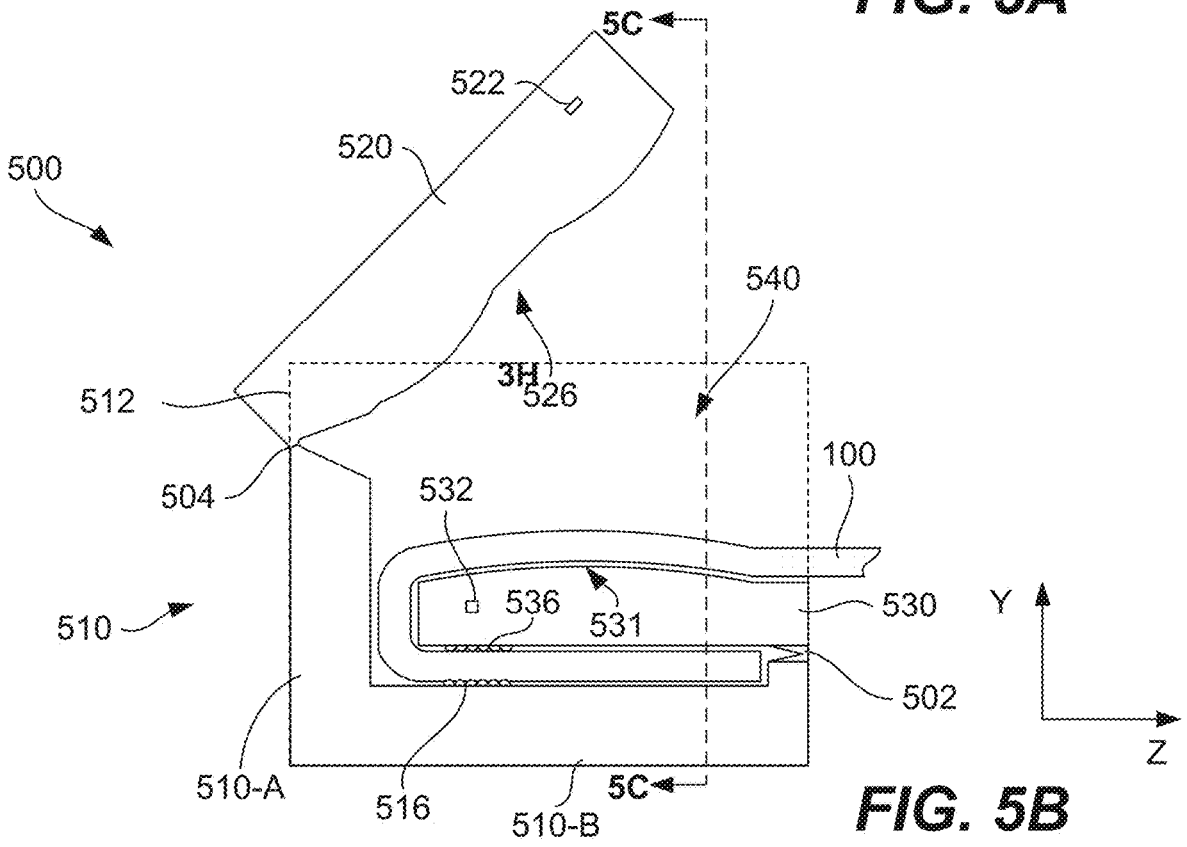
Figure 5C:
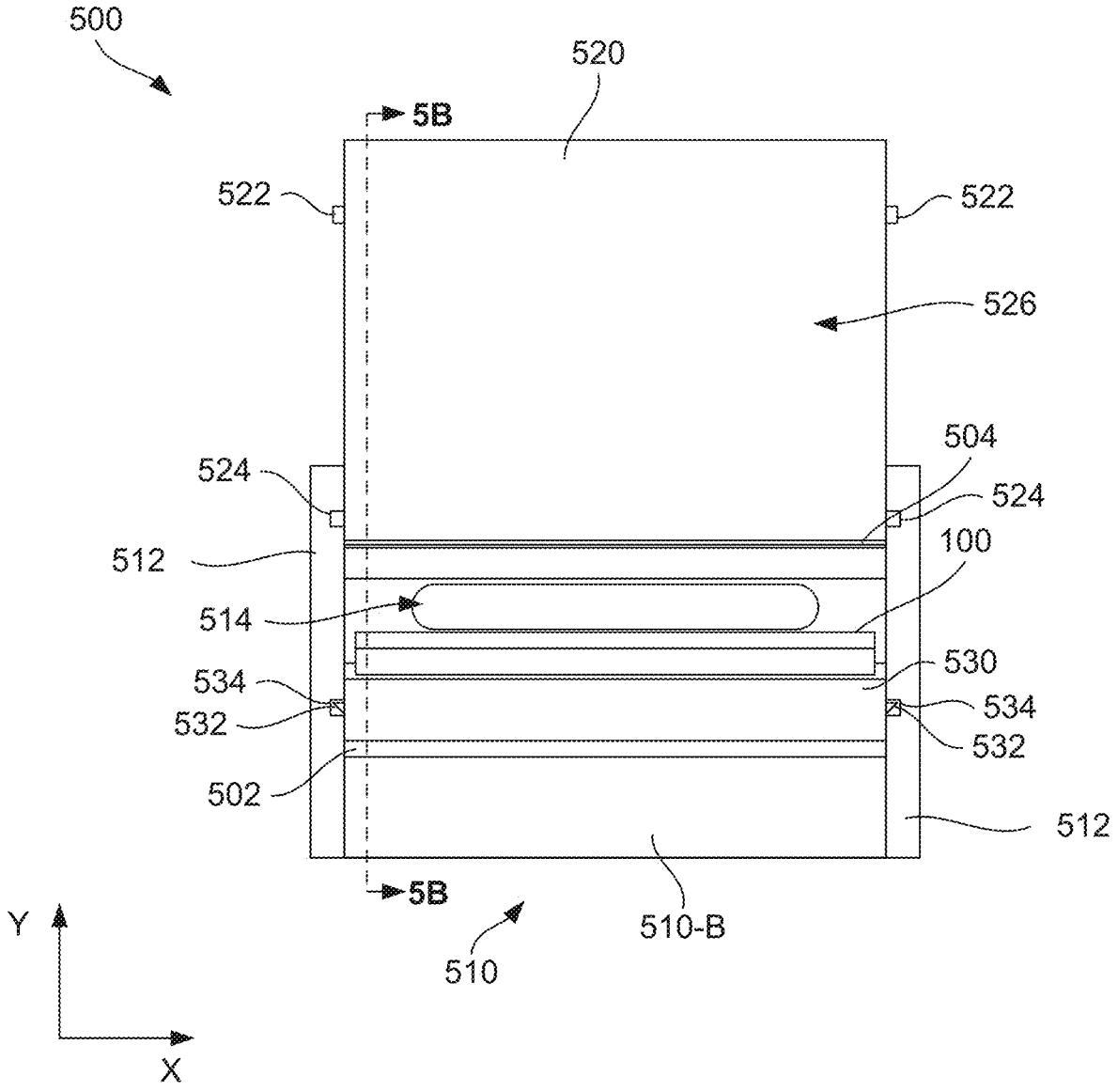

Once flex circuit 100 is in the desired position, such as that shown in FIG. 5A, circuit clamp 530 is rotated about hinge 502 into housing chamber 540 into a second configuration, or clamped configuration. FIG. 5B shows a side view cross-section of connector 500 in a clamped configuration from the 5B-5B viewpoint shown in FIG. 5C. FIG. 5C shows a back view of connector 500 in the clamped configuration from the 5C-5C viewpoint shown in FIG. 5B.

In the second (clamped) configuration, the flex circuit is secured between the circuit clamp and the inner surface of the bottom wall of base 510. As shown in FIG. 5B, grip surfaces 516 and 536 are aligned and apply additional securing forces against both sides of the flex circuit. Protrusions 532 of the circuit clamp may be aligned with slots 534 within side walls 512. For example, as the clamp piece is placed into the clamped position, protrusions 532 may cause side walls 512 to slightly expand outward laterally until each protrusion is aligned and positioned within corresponding slots 534 (shown in FIG. 5C) causing the clamp piece to snap in place. This configuration may secure the clamp piece in the clamped position and apply continuous force on the flex cable between the clamp piece and the base.

Because the flex circuit is wrapped around the surface of the clamp piece, the frictional forces are increased and further prevent the flex circuit from being pulled away from or out of the housing chamber. In some embodiments, the PSA backing of the flex circuit may further adhere to the upper surface of the clamp piece to secure the flex circuit in place. As shown, circuit clamp 530 may include a convex upper surface 531, such that the flex circuit conforms to the geometry of upper surface 531.

Figure 5D:
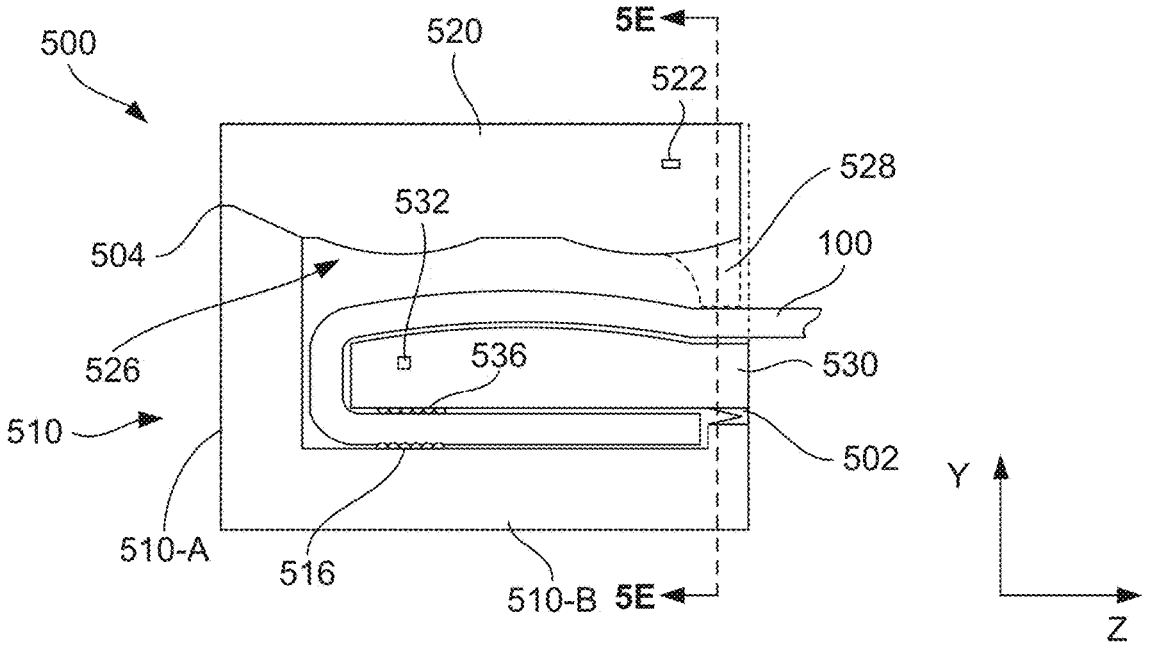
Figure 5E:
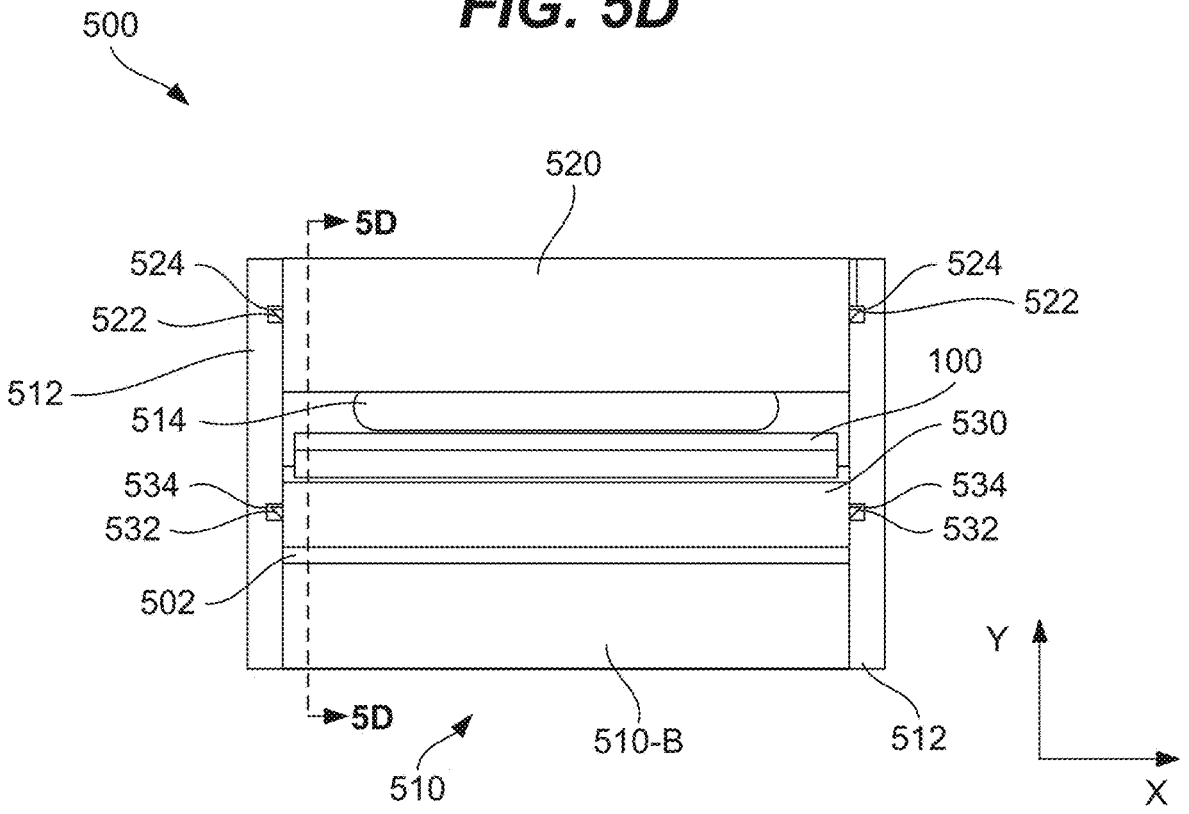

Once the clamp piece and flex circuit are secured in the clamped configuration, cover piece 520 may be moved about hinge 504 into the third configuration, or pre-loaded configuration, as shown in FIGS. 5D and 5E. FIG. 5D shows a side view cross-section of connector 500 in the pre-loaded configuration from the 5D-5D viewpoint shown in FIG. 5E. FIG. 5E shows a back view of connector 500 in the pre-loaded configuration from the 5E-5E viewpoint shown in FIG. 5D. The protrusions 522 of cover piece 520 may be configured to secure the cover piece in the pre-loaded configuration. Similar to the protrusions of the clamp piece, protrusions 522 may snap or fit into a secured position when aligned with slots 524 in side walls 512. In some embodiments, cover piece 520 may include a clamp portion 528 to further secure the flex circuit between the clamp portion 528 and the clamp piece, as shown in FIG. 5D. In various embodiments, the clamp portion 528 and corresponding portions of the clamp piece may be configured with additional grip surfaces similar to grip surfaces 516 and 536.

Figure 5F:
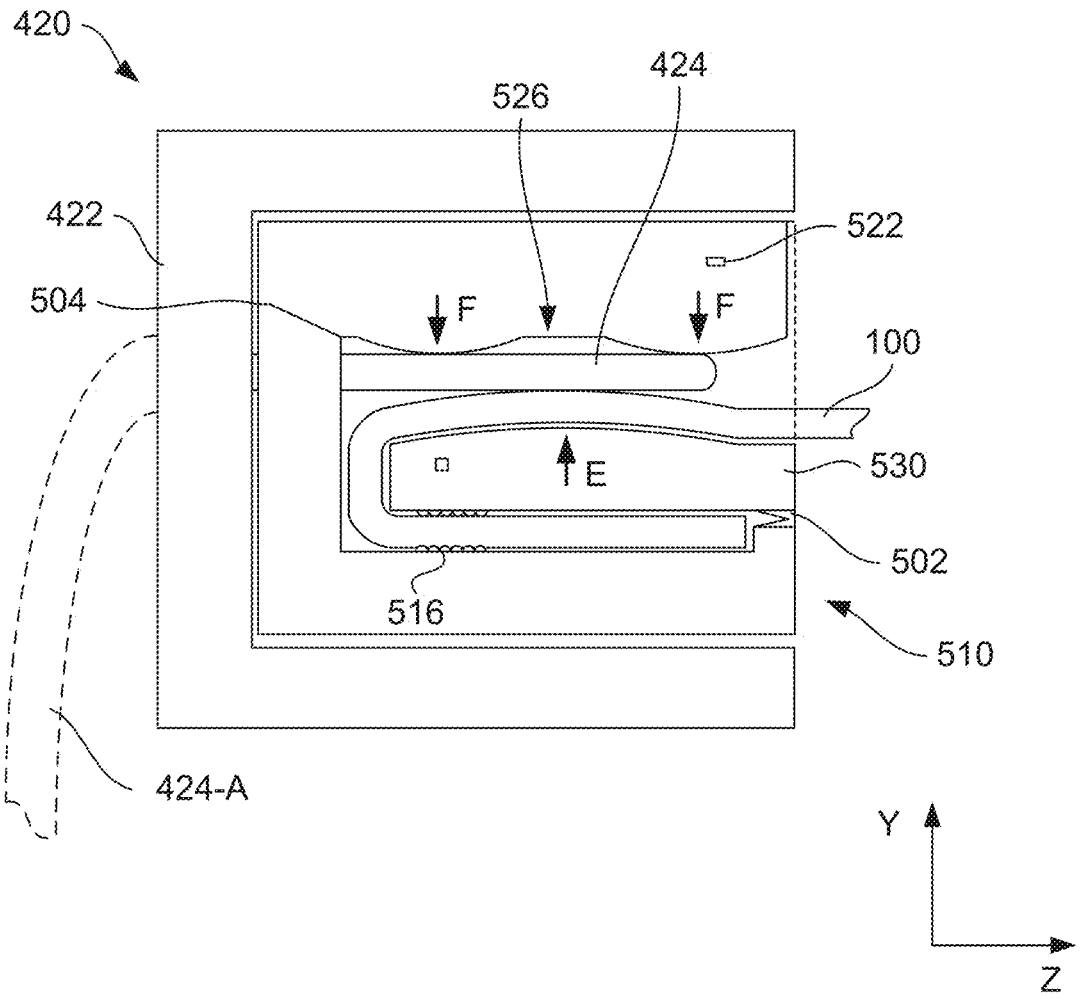

The pre-loaded circuit-side connector may then interface with a module-side connector. FIG. 5F shows cross-sectional sides view of pre-loaded connector 500 interfacing with module-side connector 420, in accordance with one or more embodiments. Module-side connector 420 may comprise module-side connector housing 422 and blades 424. As previously explained, the circuit-side connector may be configured to be inserted into the module-side connector housing, and blades 424 may be configured to be aligned with and inserted through the corresponding blade opening or openings.

Once inserted, the geometry of the contact surface 526 of the cover piece and the upper surface of the clamp piece may be configured to ensure a proper electrical contact between the flex circuit and the blades 424. For example, contact surface 526 may include one or more convex portions urging the blades downward in the directions of arrow F, while the flex circuit is supported or urged upward in the direction of arrow E by the convex upper surface of the clamp piece. In some embodiments, the convex portions of the cover piece contact surface may be aligned with the convex upper surface of the clamp piece. In some embodiment, the convex portions of the cover piece contact surface may be offset with the convex portion of the upper surface of the clamp piece. This configuration may allow space for the blades to be fully inserted while applying sufficient forces once the male blades are fully inserted. Various clamping or securing mechanisms described herein may be implemented to secure the interface of circuit-side connector and the module-side connector.

Additional embodiments of circuit-side connector housings may include a multiple separate parts for additional accessibility during the pre-loading process. FIGS. 6A, 6B, 6C, 6D, 6E, 6F, and 6G illustrate various cross-sectional views of a two piece circuit-side connector 600, in accordance with one or more embodiments. In various embodiments, the two-piece circuit-side connector 600 comprises hinged insert 601 and housing 660.

Figure 6A:
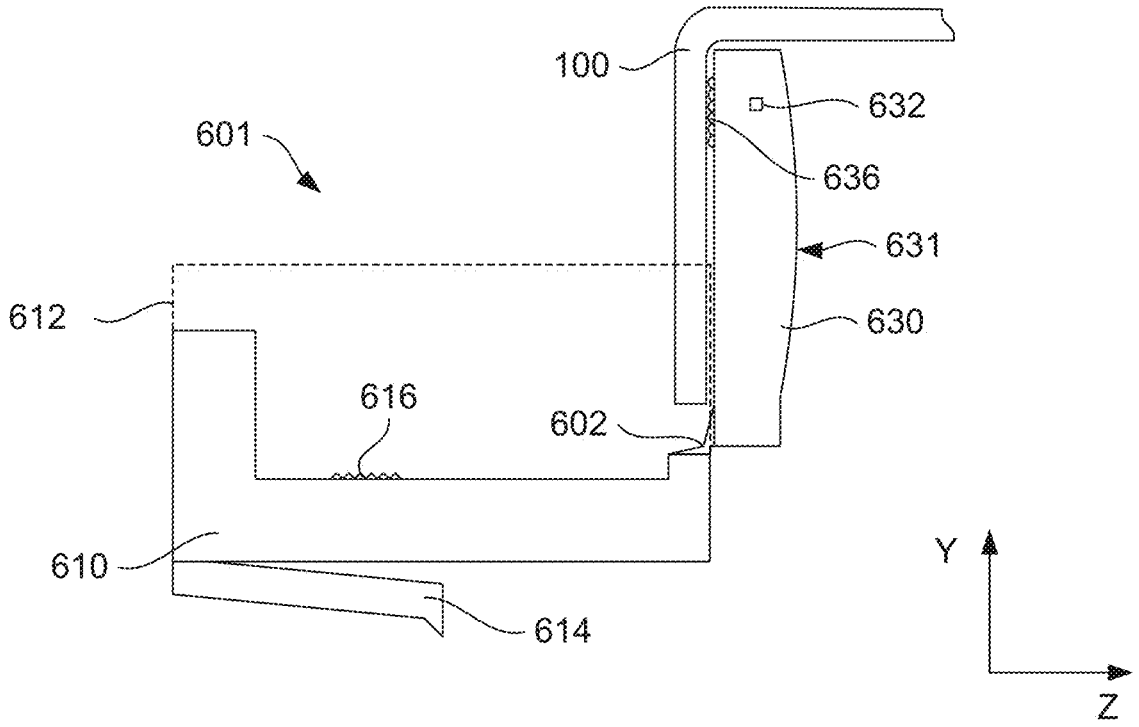
FIGS. 6A, 6B, 6C, 6D, 6E, 6F, and 6G illustrate various cross-sectional views of a two piece circuit-side connector, in accordance with one or more embodiments.
Figure 6B:
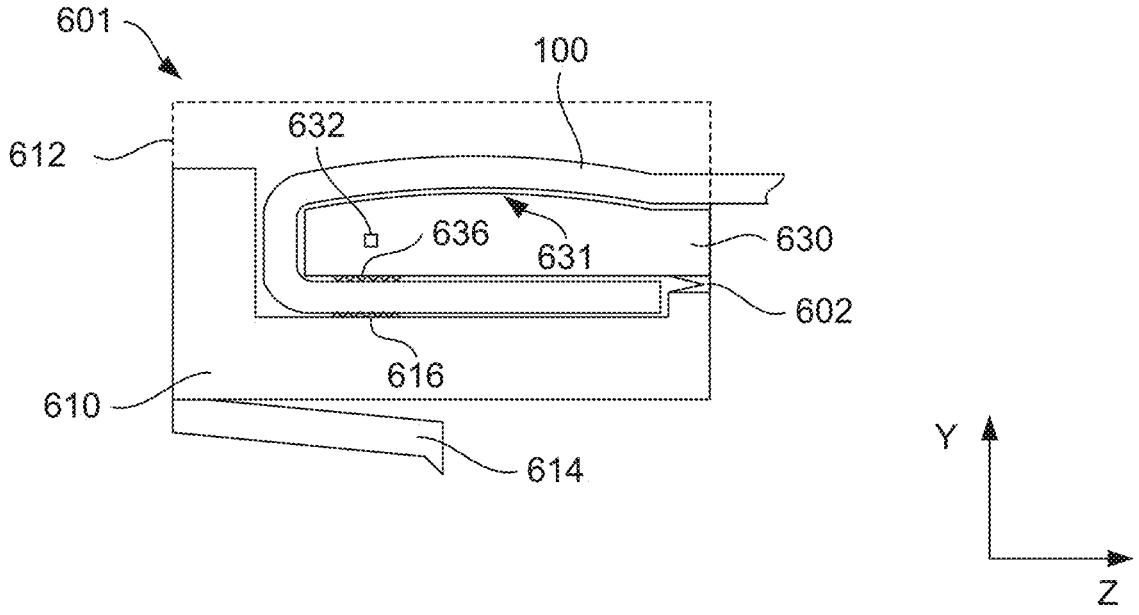

FIGS. 6A and 6B show cross-sectional side views of insert 601. Insert 601 may comprise base 610 and circuit clamp 630 (or clamp piece), which are coupled via moveable hinge 602. As discussed, hinge 602 may be any one of various mechanical hinge structures allowing clamp piece 630 to move about the hinge with respect to base 610. Base 610 of insert 601 may include side walls 612, latch 614, and grip surface 616. Clamp piece 630 may include protrusions 632 and grip surface 636.

As shown in FIG. 6A, insert 601 is in a first configuration, or open configuration. In the first (open) configuration, a flex circuit 100 may be positioned against the interior surface of the circuit clamp facing the housing chamber (as shown in FIG. 6A). As shown, the clamp piece is positioned with respect to the base at approximately 90 degrees. However, in some embodiments, hinge 602 may be configured to allow the clamp piece to open up to greater angles in order to provide increased access for the flex circuit. As previously described, the flex circuit may be PSA backed to allow the circuit to be tacked into the desired position on the inner surface of the clamp piece.

Once flex circuit 100 is in the desired position, such as that shown in FIG. 6A, circuit clamp 630 is moved about hinge 602 into a second configuration, or clamped configuration, shown in FIG. 6B. In the second (clamped) configuration, the flex circuit is secured between the circuit clamp and the inner surface of the bottom or floor of base 610. As shown in FIG. 6B, grip surfaces 616 and 636 may be aligned and apply additional securing forces against the flex circuit. Protrusions 632 may be configured to align with slots 634 within side walls 612 (shown in FIG. 6F) in the clamped configuration to secure the clamp piece in the clamped configuration. This configuration may secure the clamp piece in the clamped position to apply continuous force on the flex cable between the clamp piece and the base. The wrapping of the flex circuit around circuit clamp 630 may cause additional frictional forces to be applied to the flex circuit to further prevent the flex circuit from being pulled away from or out of insert 601. As shown, circuit clamp 630 may include a convex upper surface 631, such that the flex circuit conforms to the geometry of upper surface 631

Figure 6C:
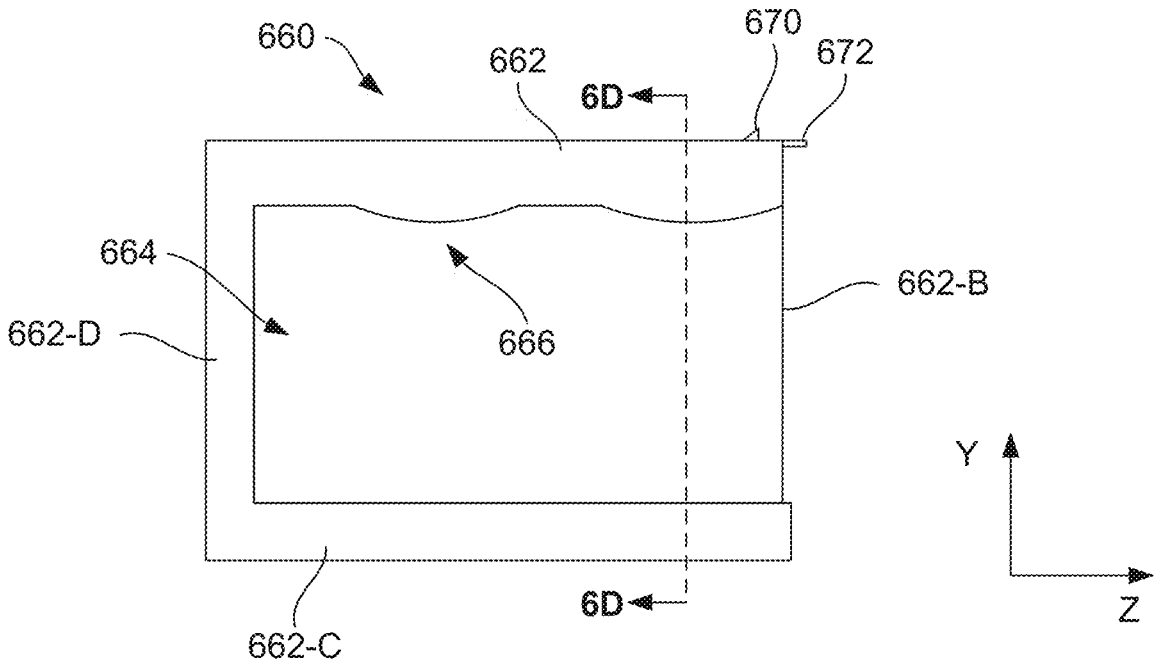
Figure 6D:
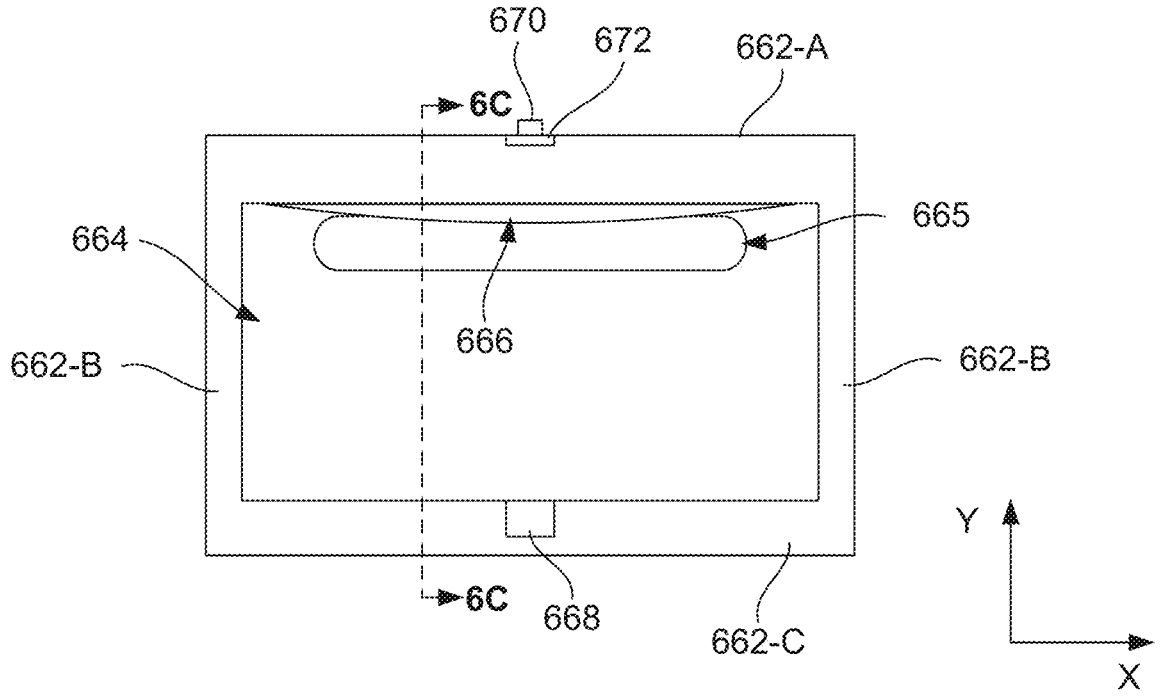

FIG. 6C shows a cross-sectional side view of housing 660 of circuit-side connector 600 from the 6C-6C viewpoint shown in FIG. 6D. FIG. 6D shows a back view of housing 660 of circuit-side connector 600 from the 6D-6D viewpoint shown in FIG. 6C. In various embodiments, circuit-side housing 660 comprises an upper wall 662-A, two side walls 662-B, and a floor 662-C, which define housing chamber 664. The housing may further comprise a forward interface surface or wall 662-D which includes one or more blade openings 665. As previously described, blade opening 665 may comprise a single continuous opening which allows multiple blades to pass through, or may include multiple separate blade openings each corresponding to a respective blade. Housing 660 further comprises contact surface 666 on the upper portion within housing chamber 664 and latch guide 668. In some embodiments, housing 660 may also include protrusion 670 and lever tab 672 for securing onto or releasing from a module-side connector.

Figure 6E:
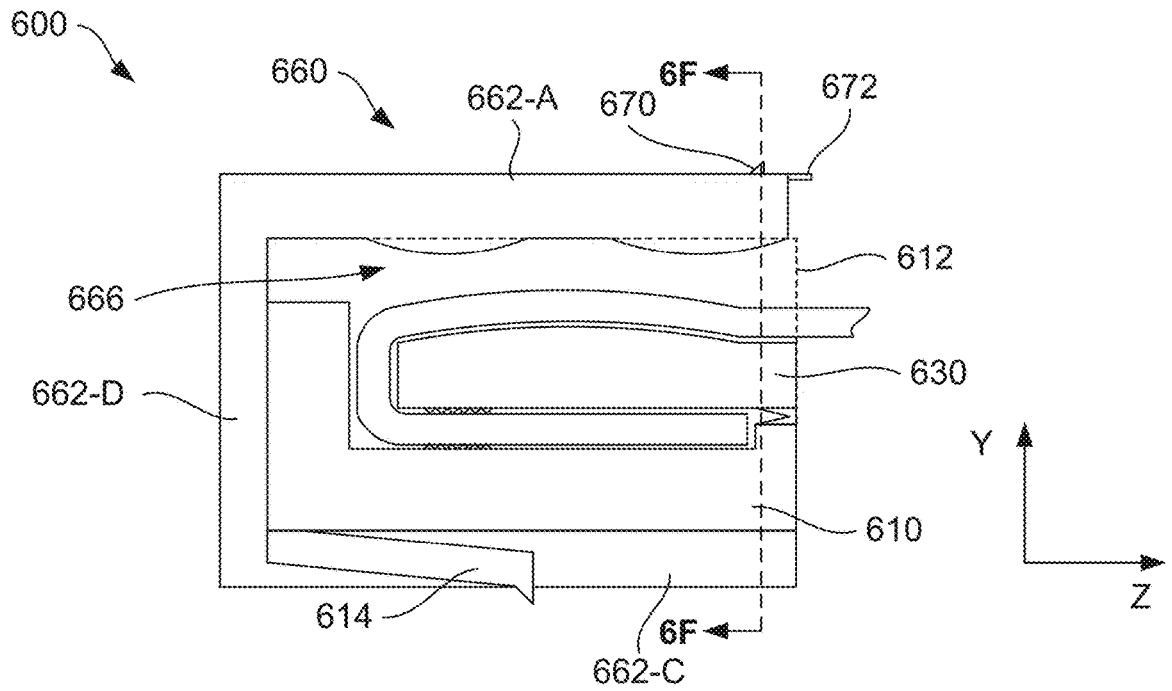
Figure 6F:
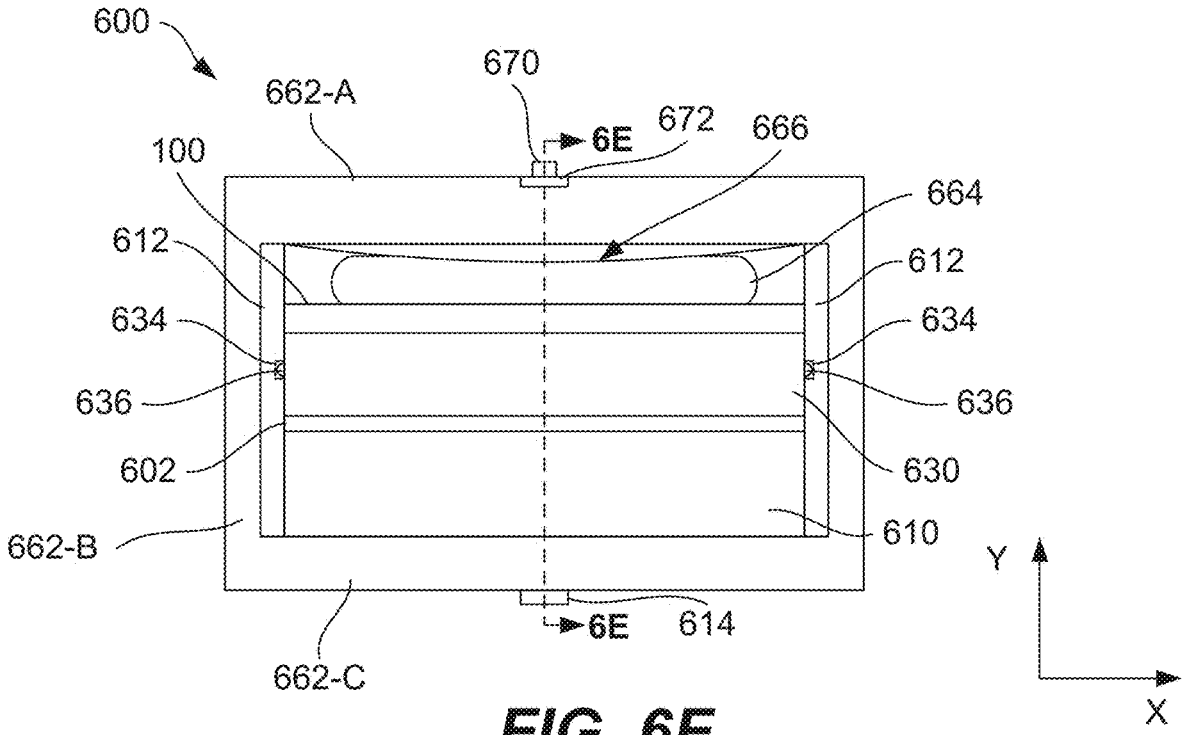

Once the clamp piece and flex circuit are secured in the clamped configuration, insert 601 may be inserted into housing 660 into a third configuration, or pre-loaded configuration, as shown in FIGS. 6E and 6F. FIG. 6E shows a side view cross-section of circuit-side connector 600 in the pre-loaded configuration from the 6E-6E viewpoint shown in FIG. 6F. FIG. 6F shows a back view of connector housing 500 in the pre-loaded configuration from the 6F-6F viewpoint shown in FIG. 6E. Latch 614 may be configured to travel through latch guide 668 and snap into place once it is properly aligned with a slot within the latch guide to secure the insert 601 and housing 660 in the pre-loaded configuration.

Figure 6G:
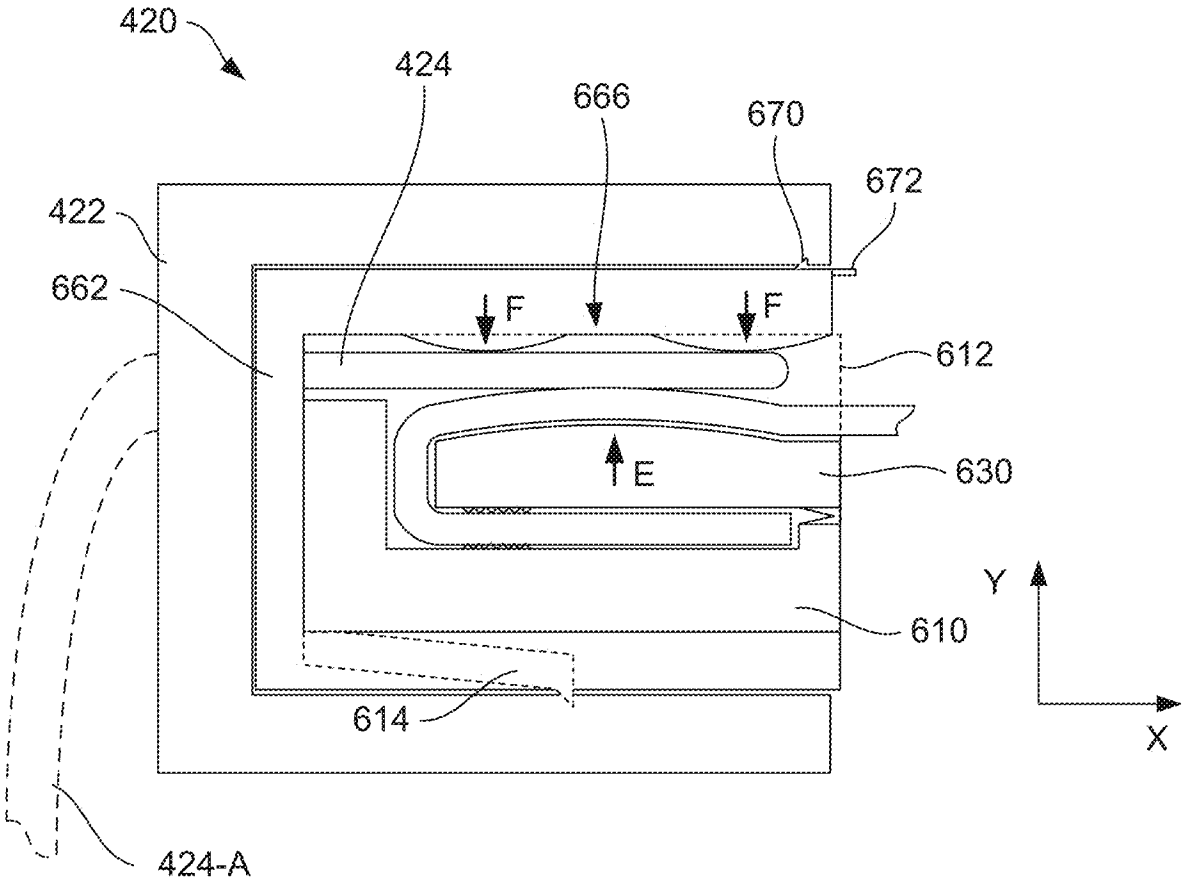

The pre-loaded circuit-side connector housing 660 may then be interfaced with a module-side connector housing. FIG. 6G shows a cross-sectional side view of pre-loaded connector 600 interfacing with module-side connector 420, in accordance with one or more embodiments. Module-side connector 420 may comprise module-side connector housing 422 and blades 424. As previously explained, the circuit-side connector may be configured to be inserted into the module-side connector housing, and blades 424 may be configured to be aligned with and inserted through the corresponding blade opening or openings.

Once inserted, the geometry of the contact surface 666 of housing 660 and the upper surface of the clamp piece may be configured to ensure a proper electrical contact between the flex circuit and the blades 424. Similar to contact surface 526, contact surface 666 may include one or more convex portions urging the blades downward in the directions of arrow F, while the flex circuit is supported or urged upward in the direction of arrow E by the convex upper surface of the clamp piece. In some embodiments, the convex portions of the cover piece contact surface may be aligned with the convex upper surface of the clamp piece. In some embodiment, the convex portions of the cover piece contact surface may be offset with the convex portion of the upper surface of the clamp piece. This configuration may allow space for the blades to be fully inserted while applying sufficient forces once the male blades are fully inserted. Various clamping or securing mechanisms described herein may be implemented to secure the interface of circuit-side connector and the module-side connector.

Protrusion 670 of housing 660 may be configured to insert into a socket within housing 422 of module-side connector 420 to secure the components in the interfaced configuration. In some embodiments, lever tab 672 may be used to deform a portion of housing 660 to release protrusion 670 from the corresponding socket in order to release connector 600 from connector 420. In some embodiments, latch 614 may also function to secure the interfaced configuration be inserting into a socket or space at the bottom of module-side connector housing 422.

It should be recognized that various known latching mechanisms, and combinations thereof, may be implemented to secure the various components of the embodiments described herein. In some cases, the latching mechanisms described for one embodiment may be implemented in other described embodiments or for securing different components of the same embodiment. In some embodiments, the described components may be secured through other means, such as adhesives, welding, brazing, soldering, or the like.

Figure 7A:
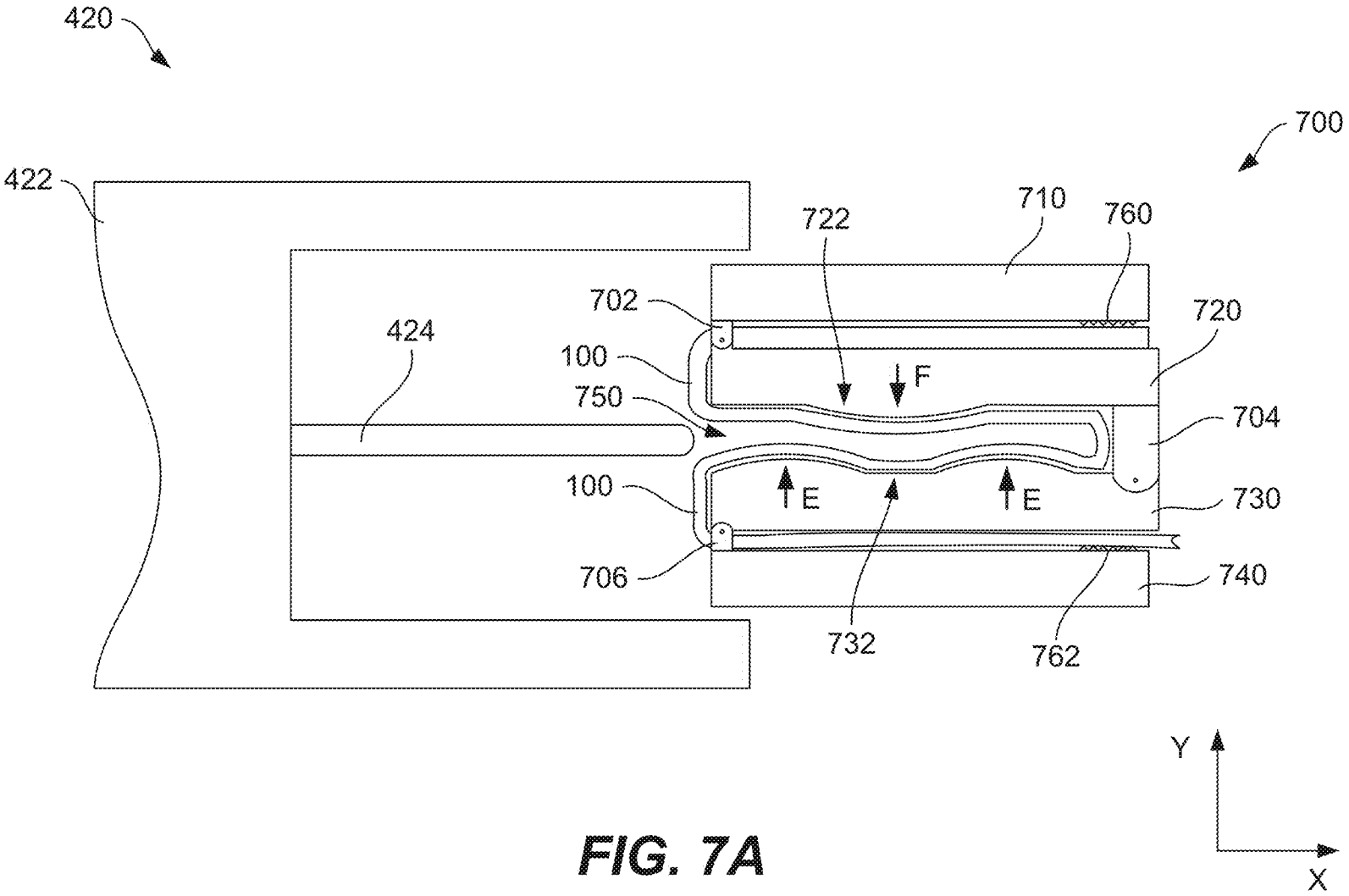
FIGS. 7A and 7B illustrate a cross-sectional view of another multi-hinged circuit-side connector, in accordance with one or more embodiments.
Figure 7B:
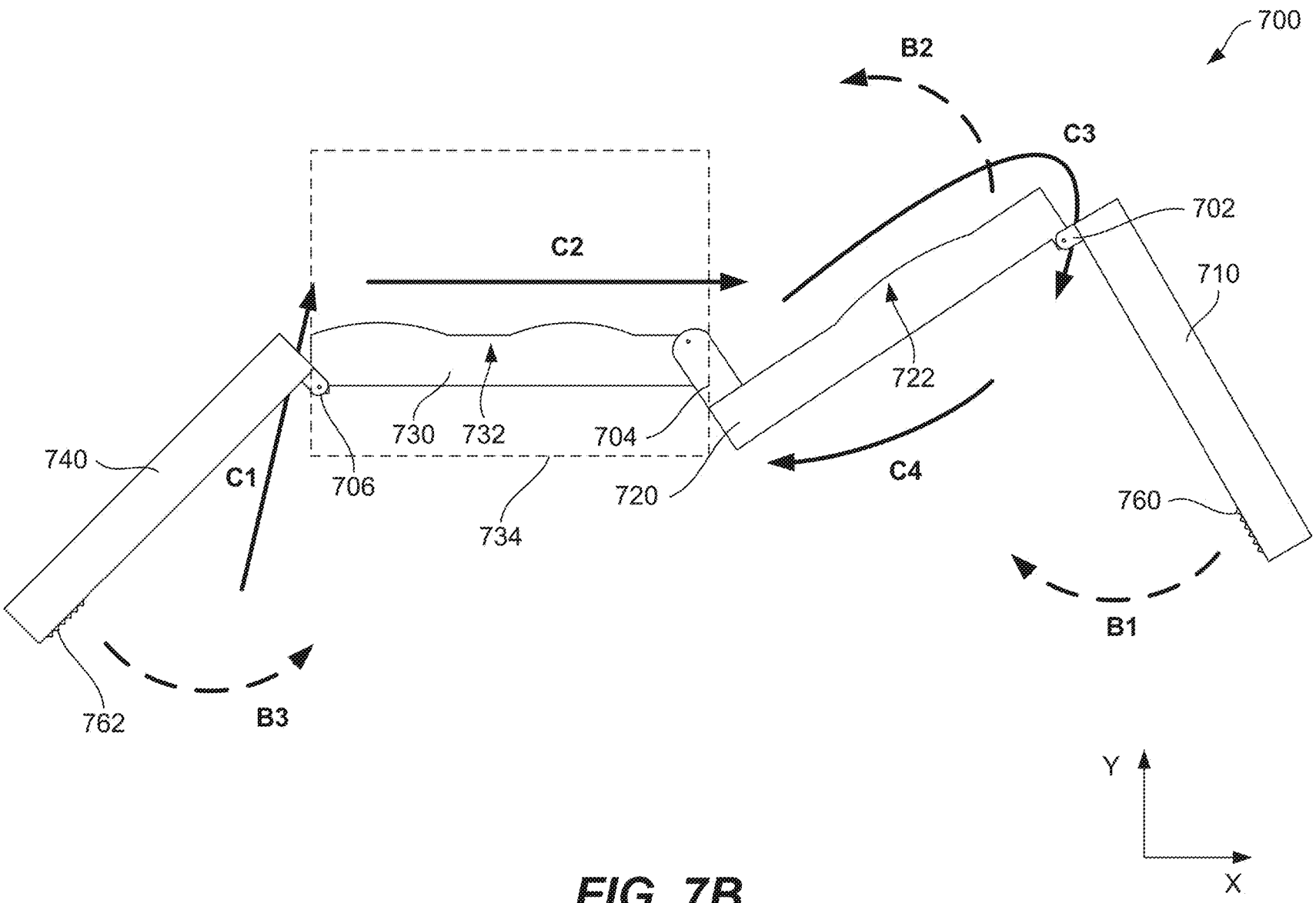

FIGS. 7A and 7B illustrate a cross-sectional view of another multi-hinged circuit-side connector 700, in accordance with one or more embodiments. As shown, connector 700 comprises housing components 710, 720, 730, and 740. Component 710 is coupled to component 720 via hinge 702, component 720 is coupled to component 730 via hinge 704, and component 730 is coupled to component 740 via hinge 706. The hinges may be any one of various mechanical hinge structures allowing the components to move about with respect to one another. For example the hinges may be living hinges constructed from the same material and structure as each of the housing components. However, other types of hinges may be implemented, such as ball bearing hinges, barrel hinges, butt hinges, piano hinges, leaf hinges, and others.

The multi-hinged configuration may allow the flex circuit 100 to be pre-loaded in such a way as to create blade cavity 750 which would surround the top and bottom of male blades 424 to increase the surface area of electrical contact between the blades and the flex circuit. FIG. 7B shows an open configuration, of connector 700 to provide access for loading a flex circuit 100. The flex circuit may be inserted through slots or spacing between respective hinges joining components, as shown through consecutive arrows C1, C2, C3, and C4. In some embodiments, the end of the flex circuit may be positioned at or near the end of arrow C4. It should be understood that a flex circuit could be loaded into connector 700 in the opposite direction of arrows C1-C4.

Once the flex circuit has been adequately positioned, components 710-740 may be moved about respective hinges to secure the flex circuit in place in a pre-loaded configuration, such as shown in FIG. 7A. For example, component 710 may be rotated about hinge 702 to secure the flex circuit against component 720. Component 720 may be moved about hinge 704 relative to component 730 in order to position the flex circuit so as to form blade cavity 750. Finally, component 740 may be moved about hinge 706 relative to component 730 in order to secure the flex circuit against component 730.

In various embodiments, the moveable components 710, 720, 730, and 740 may be secured into the desired position by protrusions that align and interface with slots within side walls 734 shown using dashed lines in FIG. 7B. In some embodiments, walls 734 may be part of the structure of component 730, such that components 710, 720, and 740 move with respect to walls 734. In various embodiments, components of connector 700 may be secured to each other via various fastening mechanisms.

In some embodiments, grip surface 760 of component 710 may apply additional force against the flex circuit and component 720, and grip surface 762 of component 740 may apply additional force against the flex circuit and component 730. In some embodiments, additional grip surfaces may be configured on components 720 and 730 and aligned with grip surfaces 760 and 762, respectively.

Referring back to FIG. 7A, components 720 and 730 may include contact surfaces 722 and 732, respectively. Such contact surfaces may include one or more convex portions which would cause the flex circuit to take on a corresponding geometry when pre-loaded. When the blades 424 are inserted into blade cavity 750, the geometry may urge the flex circuit downward in the direction of arrow F and upwards in the direction of arrows E to ensure a successful electrical contact between the blades and the flex circuit. The convex portions of the cover piece contact surface may be offset with the convex portion of the upper surface of the clamp piece. This configuration may allow space for the blades to be fully inserted while applying sufficient forces once the male blades are fully inserted.

FIGS. 8A, 8B, 8C, 8D, and 8E illustrate various cross-sectional views of a spring guided circuit-side connector 800, in accordance with one or more embodiments. As depicted, circuit-side connector 800 comprises housing 810 defining housing chamber 811. In some embodiments, housing chamber 811 is further defined by side walls 810-A of housing 810. Housing 810 may include blade opening 860 at one end. At the opposite end, a slider 820 is configured to travel within the housing chamber between an extended position (shown in FIGS. 8A and 8B) and an inserted position (shown in FIG. 8C). In some embodiments, slider 820 comprises a convex contact surface 824 with grip surface 826, and latch 822.

Connector 800 may further comprise spring guide 840. In various embodiments, spring guide 840 includes a sloped surface facing the blade opening. In some embodiments, spring guide 840 is spring-loaded and includes a mechanical spring mechanism 841. Various spring mechanism types may be implemented as spring mechanism 841, including compression springs, accordion springs, disc springs, torsion springs, conical springs, and the like. In certain embodiments, spring mechanism 841 may be constructed from the same material as housing 810. In some embodiments, spring guide 840 may be constructed from the same material as housing 810 and may be a single structure with the housing. For example, the housing, the spring guide, and the spring mechanism may be 3D printed and comprise a monolithic structure. However, in some embodiments, spring guide 840 or spring mechanism 841 may be a separate structure from housing 810.

Figure 8A:
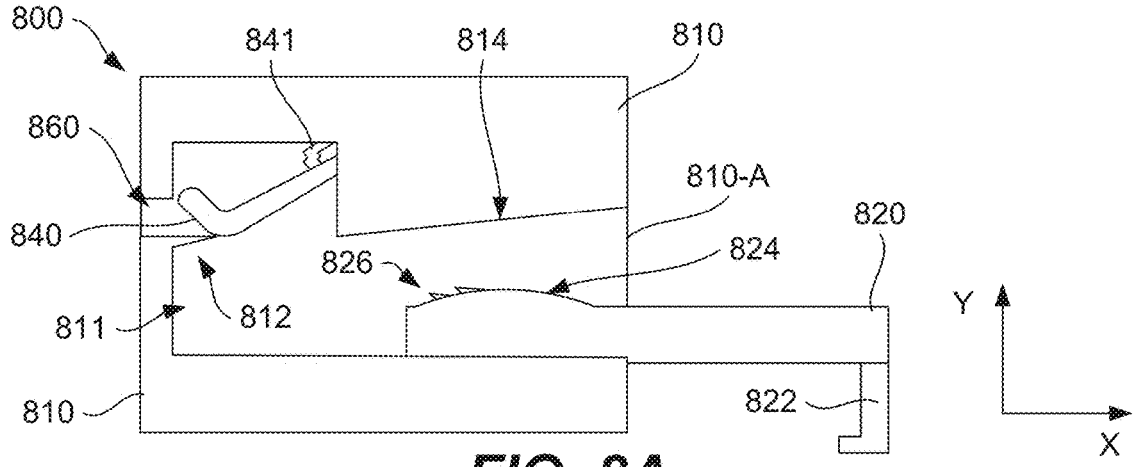
FIGS. 8A, 8B, 8C, 8D, and 8E illustrate various cross-sectional views of a spring guided circuit-side connector, in accordance with one or more embodiments.
Figure 8B:
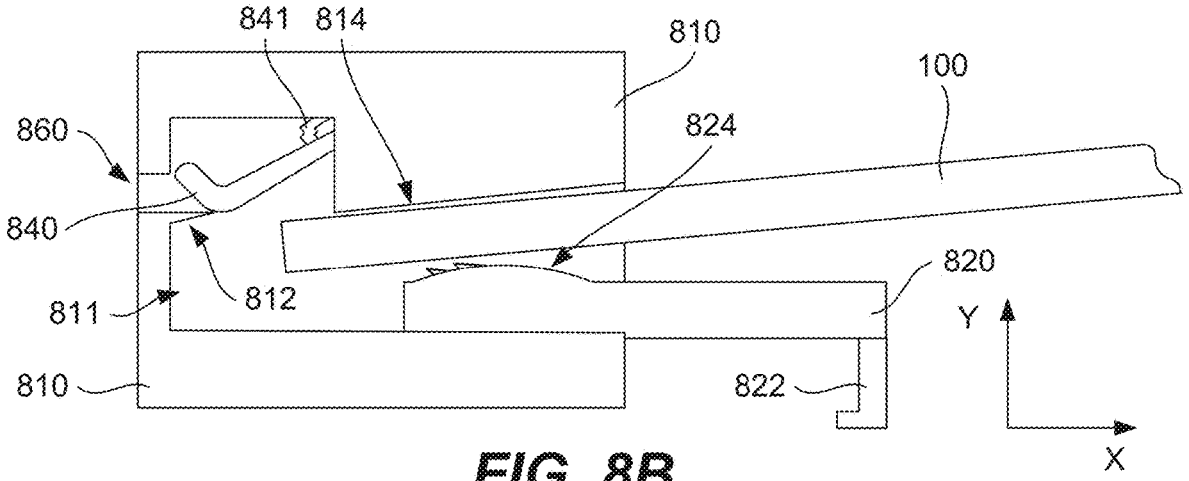

A flexible interconnect circuit, such as flex circuit 100 may be inserted into housing chamber 811 for pre-loading, as shown in FIG. 8B. In some embodiments, housing 810 may include a slanted loading surface 814 to provide increased access for the flex cable. In some embodiments, slanted loading surface 814 may also maintain the flex cable at a slight downward angle. In some embodiments, slider 820 may be fully removed from the housing to create an even greater space for inserting the flex cable.

Figure 8C:
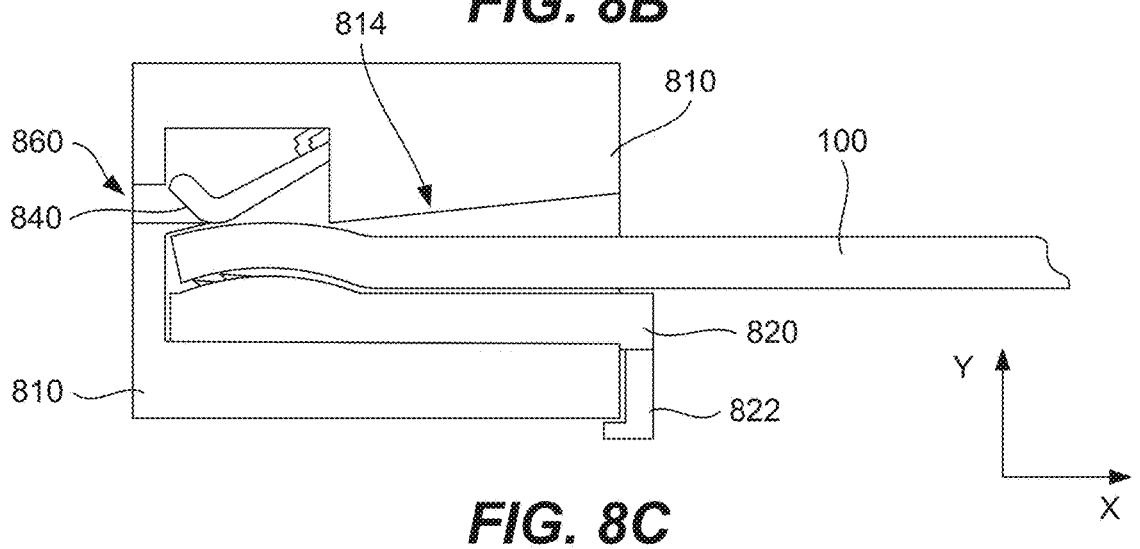

Once the flex cable has been partially inserted, slider 820 may be used to move the flex cable into the fully pre-loaded configuration (shown in FIG. 8C). With reference to previously discussed grip surfaces, grip surface 826 of the slider may be configured with materials or structures with a geometry that is suitable for gripping the flex cable as slider is inserted into the housing. The convex contact surface 824 may further support frictional contact between the slider and the flex circuit. As the flex circuit is moved inward, it slides underneath ledge 812 of housing 810. In some embodiments, this motion of the flex cable may be supported by the downward angle of the flex cable, as well as the geometry of the spring guide.

In the fully pre-loaded configuration, the flex cable may be securely positioned within the housing by forces applied between the contact surface of the slider and the ledge and/or loading surface of the housing. Latch 822 may be used to secure the slider onto the housing in the inserted position.

Figure 8D:
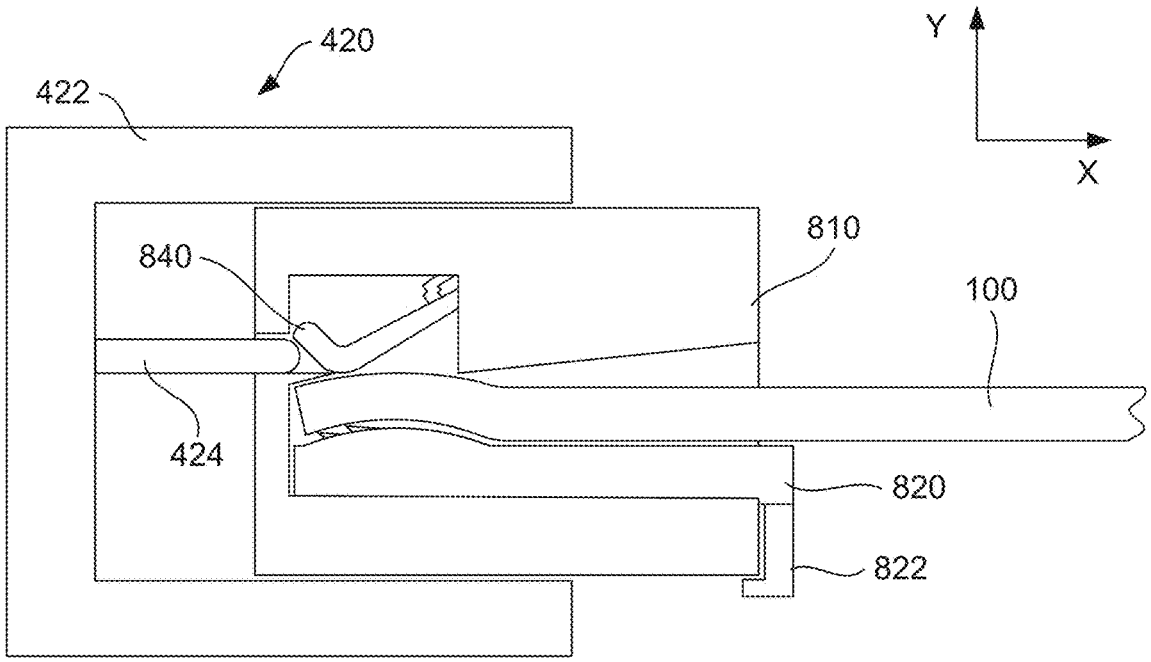

A module-side connector 420 may then interface with the pre-loaded circuit-side connector 800. As connector 800 is inserted into the housing 422 of module-side connector 420, the blades 424 of the module-side connector travel through blade opening 860, as shown in FIG. 8D. As blades 424 enter housing 810, the blades may contact the sloped surface of spring guide 840, pushing the spring guide upwards to make way for the blades 424.

Figure 8E:
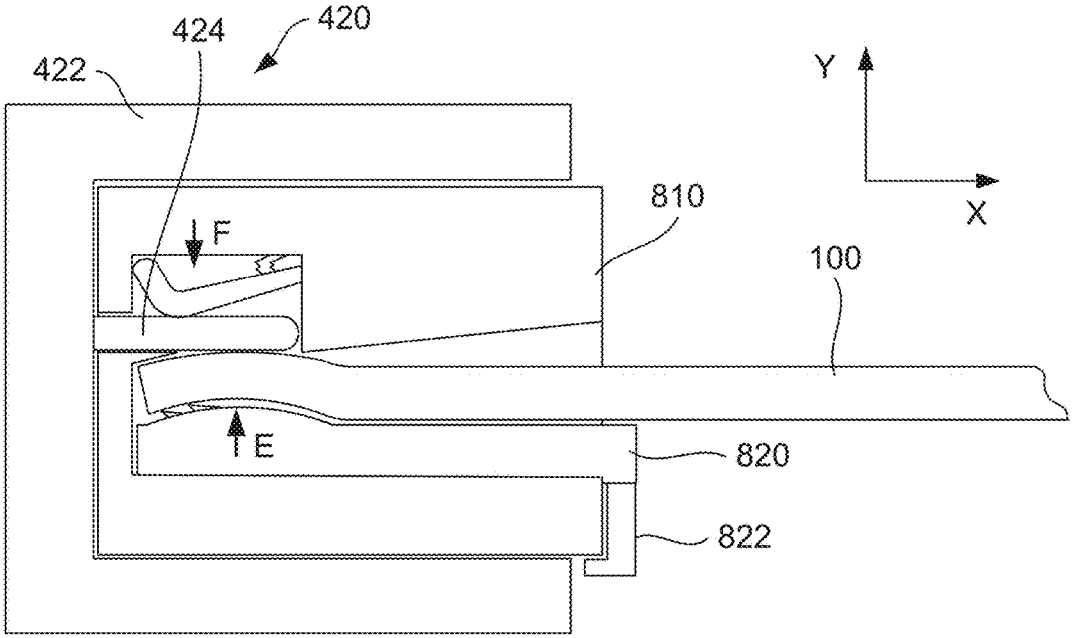

FIG. 8E shows connector 800 and connector 420 fully interfaced. In this configuration, contact between the blades and the flex cable is supported by the convex geometry of the contact surface of the slider pushing the flex circuit upward in the direction of arrow E, and the downward force on the blades generated by the spring guide in the direction of arrow F.

FIGS. 9A, 9B, 9C, and 9D illustrate various cross-sectional views of another spring guided circuit-side connector 900, in accordance with one or more embodiments. As depicted, circuit-side connector 900 comprises housing 910 defining housing chamber 911. In some embodiments, housing chamber 911 is further defined by side walls 910-A. Housing 910 may include blade opening 960 at one end. At the opposite end, a slider 920 is configured to travel between an extended position (shown in FIGS. 9A and 9B) and an inserted position (shown in FIG. 9D). In some embodiments, slider 920 comprises a convex contact surface with a grip surface similar to that of slider 820.

Connector 900 may further comprise spring guide 940. In various embodiments, spring guide 940 includes a sloped surface facing the blade opening. In some embodiments, spring guide 940 is spring-loaded and includes a mechanical spring mechanism 941. Various spring mechanism types may be implemented as spring mechanism 941, including compression springs, accordion springs, disc springs, torsion springs, conical springs, and the like. In certain embodiments, spring mechanism 941 may be constructed from the same material as housing 910. In some embodiments, spring guide 940 may be constructed from the same material as housing 910 and may be a single structure with the housing. For example, the housing, the spring guide, and the spring mechanism may be 3D printed and comprise a monolithic structure. However, in some embodiments, spring guide 940 or spring mechanism 941 may be a separate structure from housing 910.

Figure 9A:
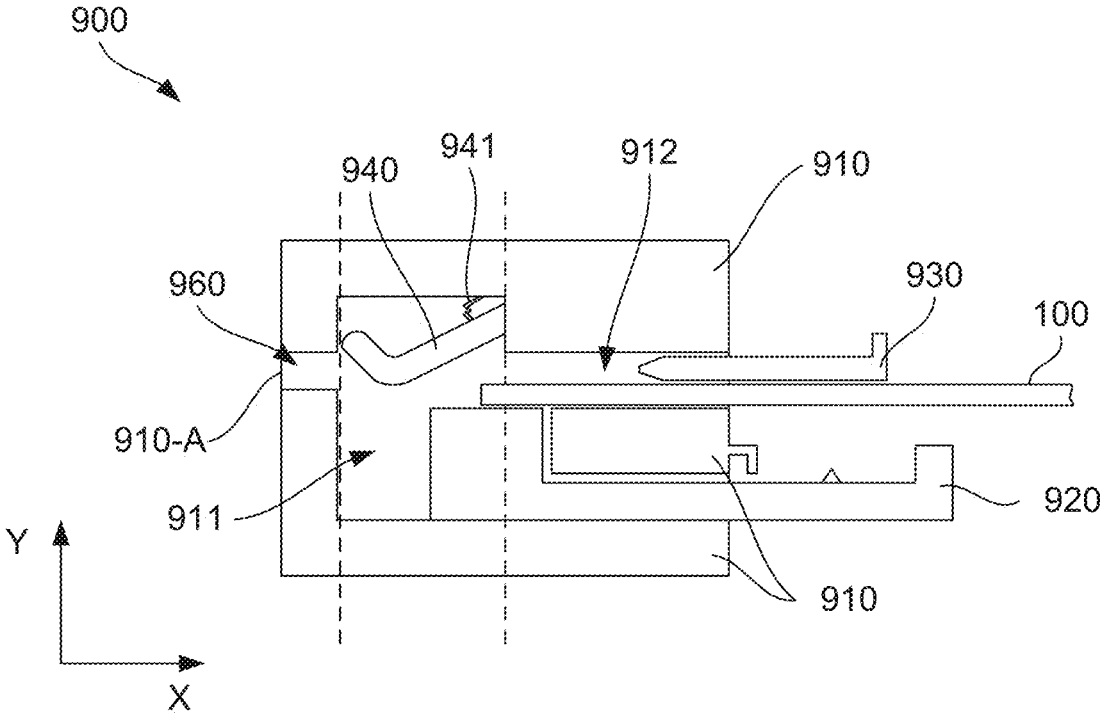
FIGS. 9A, 9B, 9C, and 9D illustrate various cross-sectional views of another spring guided circuit-side connector, in accordance with one or more embodiments.
Figure 9B:
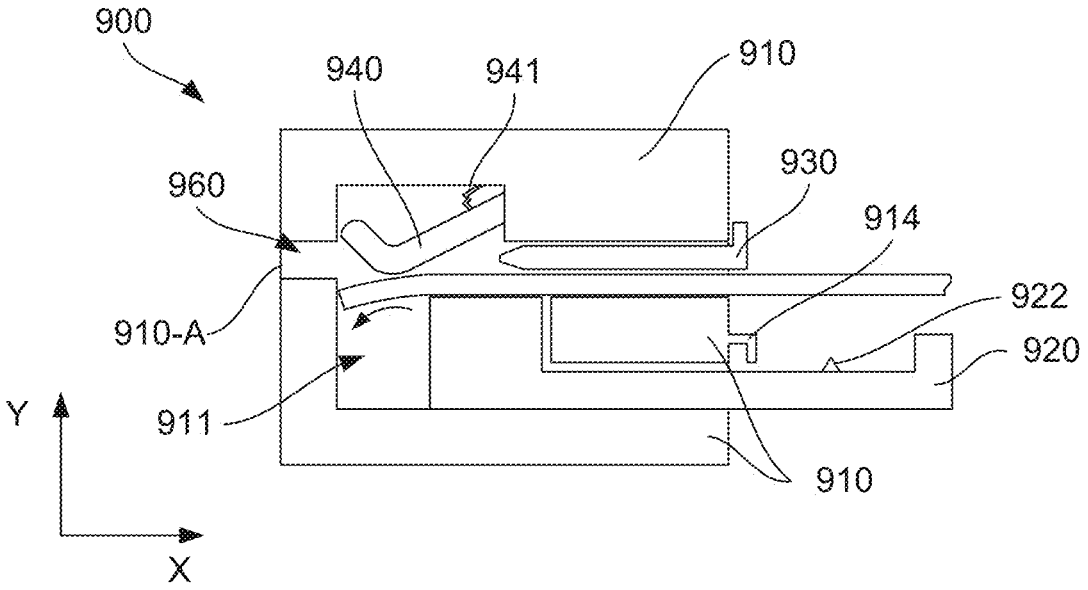

A flexible interconnect circuit, such as flex circuit 100 may be inserted into housing 910 through cable opening 912 for pre-loading, as shown in FIG. 9A. In some embodiments, connector 900 may include a wedge 930 which may be configured to assist the loading or unloading of the flex cable into the housing. Once the flex cable has been partially inserted (as shown in FIG. 9A), wedge 930 may be used to move the flex cable into the fully pre-loaded configuration by inserting the wedge into the housing (shown in FIG. 9B). In some embodiments, the geometry of spring guide 940 may cause the flex cable to bend slightly downward so as not to obstruct the blade opening, as shown in FIG. 9B. In some embodiments, housing 910 may be configured with a ledge similar to ledge 812 to further support this downward bend of the fully pre-loaded flex circuit.

Figure 9C:
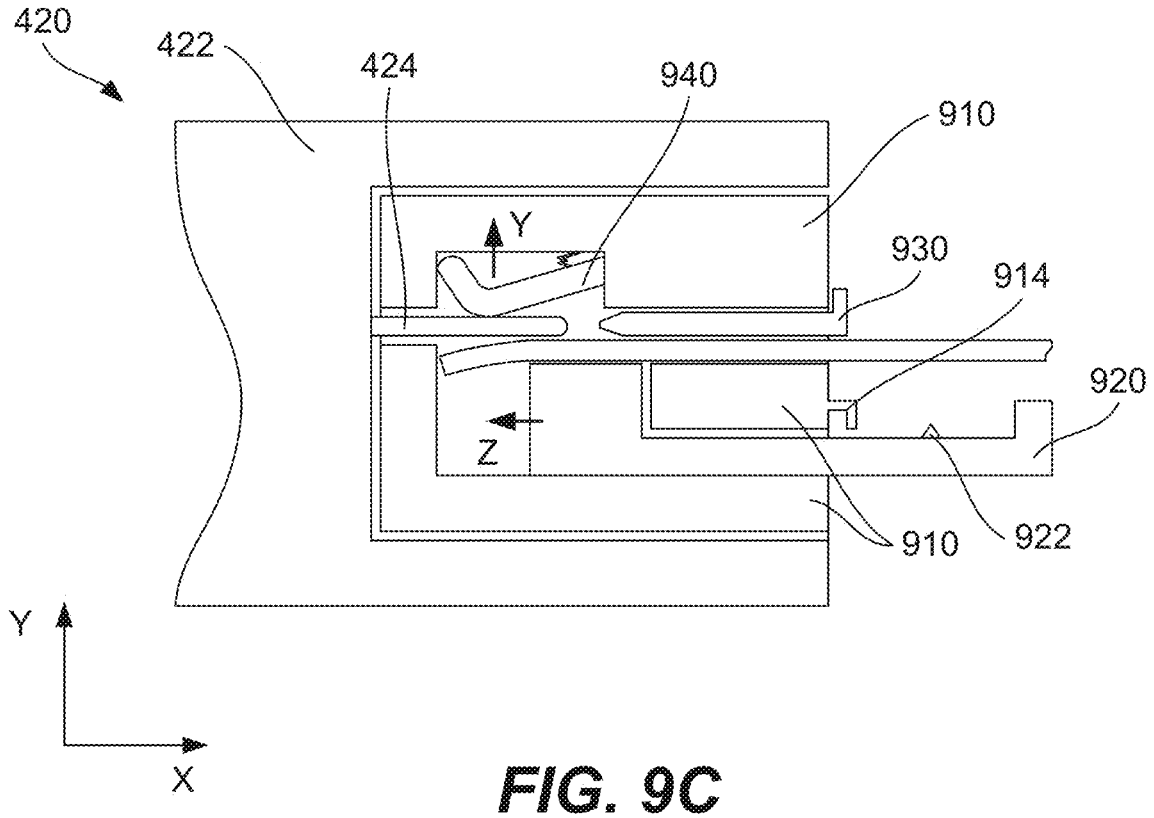

A module-side connector 420 may then interface with the fully pre-loaded circuit-side connector 900. As connector 900 is inserted into the housing 422 of module-side connector 420, the blades 424 of the module-side connector travel through blade opening 960, as shown in FIG. 9C. As blades 424 enter housing 910, the blades may contact the sloped surface of spring guide 940, pushing the spring guide upwards in the direction of arrow Y to make way for the blades 424.

Figure 9D:
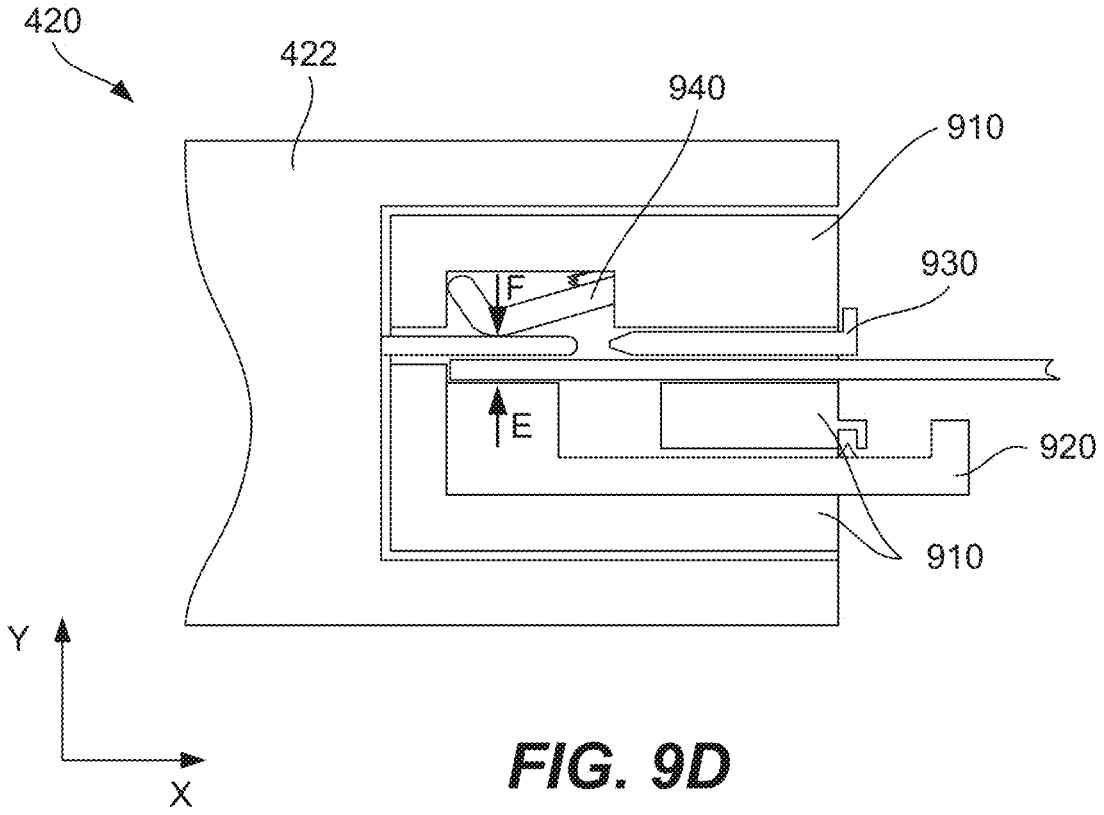

As further shown in FIG. 9C, slider 920 may then be pushed in the direction of arrow Z into the inserted position to support electrical contact between the blades and the flex circuit. In some embodiments, a strike or protrusion 922 of slider 920 may be configured to interface with latch 914 of housing 910 to secure the slider in the inserted position. FIG. 9D shows connector 900 and connector 420 fully interfaced. In this configuration, contact between the blades and the flex cable is supported by the downward force on the blades generated by the spring guide in the direction of arrow F, and the geometry of the contact surface of the slider supporting the flex circuit upward in the direction of arrow E.

FIGS. 10A-10H—Folding of the Flexible Interconnect Circuit

Figure 10A:
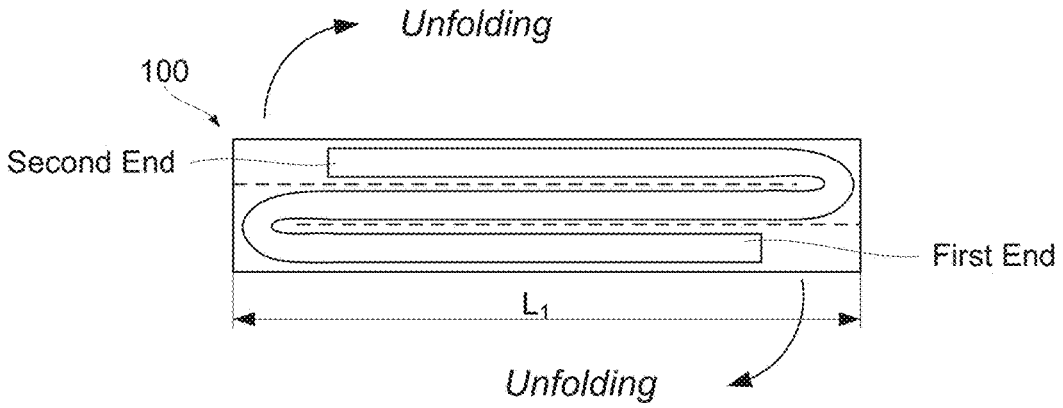
FIGS. 10A and 10B illustrate an example of unfolding a flexible hybrid interconnect circuit, in accordance with some examples.
Figure 10B:
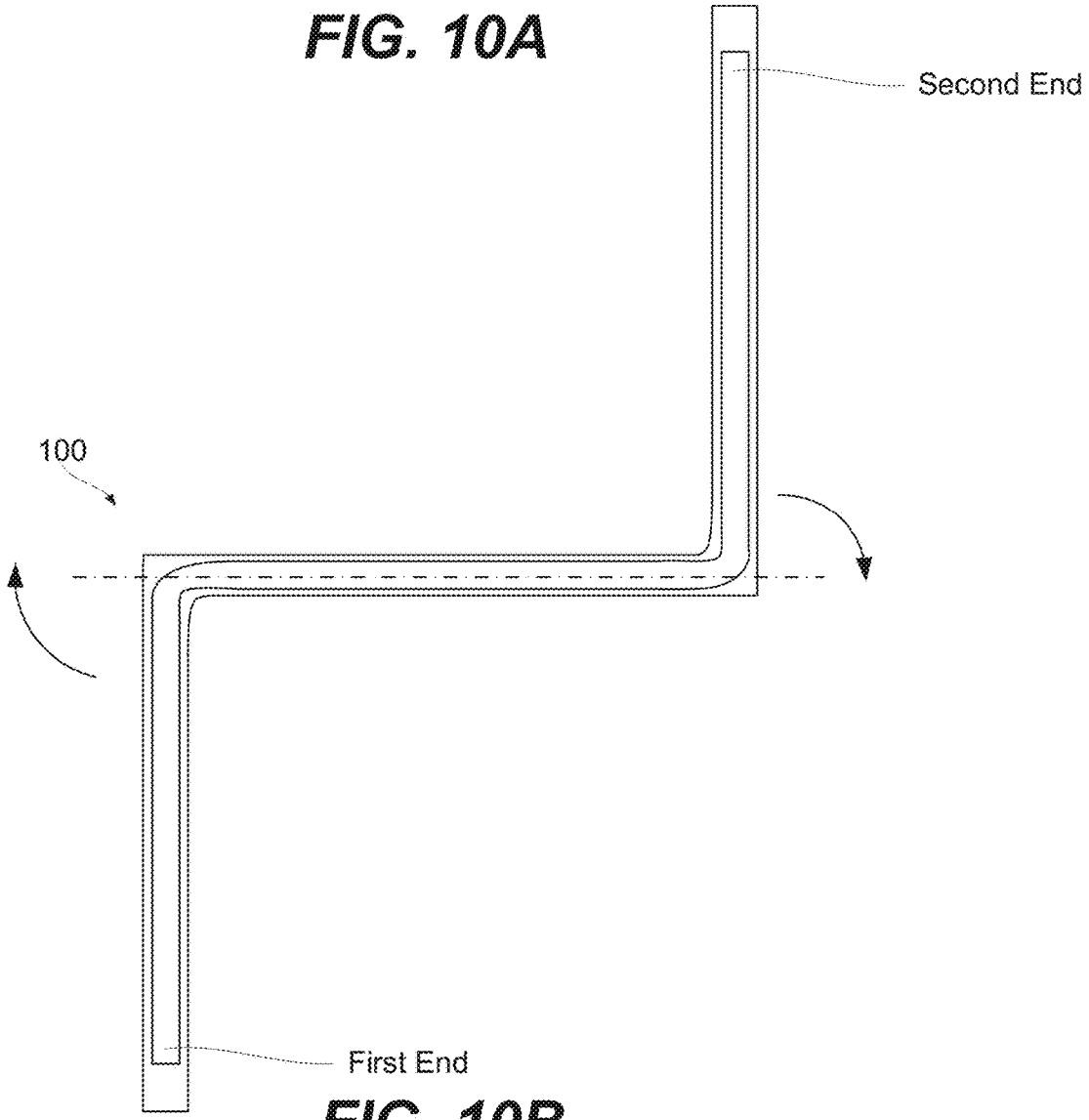

Flexible hybrid interconnect circuit 100 may be used for transmission of signals and electrical power between two distant locations. In some examples, the distance between two ends of flexible hybrid interconnect circuit 100 may be at least 1 meter or even at least 2 meters, even though the width may be relative small, e.g., less than 100 millimeters and even less than 50 millimeters. At the same time, each conductive layer of flexible hybrid interconnect circuit 100 may be fabricated from a separate metal foil sheet. To minimize material consumption and reduce waste, the manufacturing footprint of flexible hybrid interconnect circuit 100 may be smaller than its operating footprint. The flexibility characteristic of flexible hybrid interconnect circuit 100 may be used to change its shape and position after its manufacturing and/or during its manufacturing. For example, flexible hybrid interconnect circuit 100 may be manufactured in a folded state as, for example, shown in FIG. 10A. The distance between the two ends and the overall length ($L_1$) of flexible hybrid interconnect circuit 100 in the folded state may be relatively small. FIG. 10B is a schematic illustration of the same flexible hybrid interconnect circuit 100 in a partially unfolded state, showing that the distance between the two ends and the length of flexible hybrid interconnect circuit 100 has substantially increased. One having ordinary skill in the art would understand that various folding patterns are within the scope.

Figure 10C:
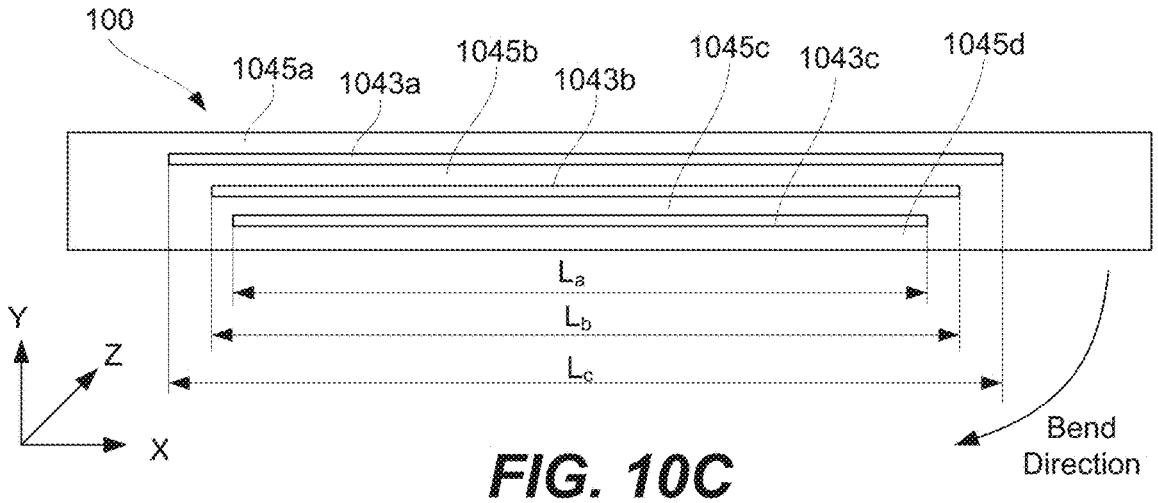
FIG. 10C illustrates a schematic top view of an insulator comprising three insulator openings that divide the insulator into four insulator strips.
Figure 10D:
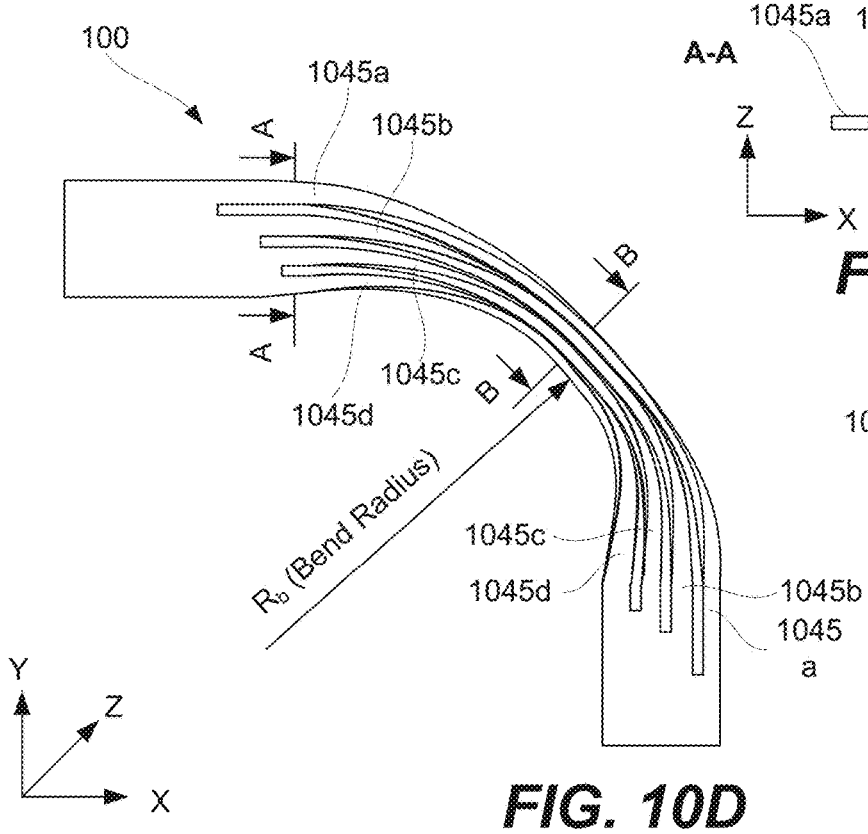
FIG. 10D illustrates a schematic top view of the insulator shown in FIG. 10C with one end of the insulator turned 90° relative to the other end within a plane.
Figure 10E:
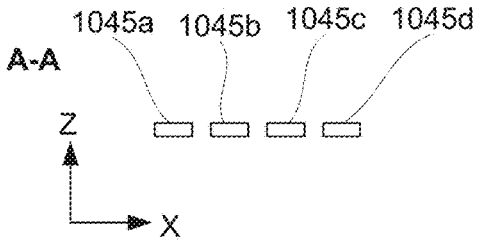
FIGS. 10E and 10F illustrate schematic cross-section views of the insulator strips of the insulator shown in FIG. 10C at different locations.
Figure 10F:
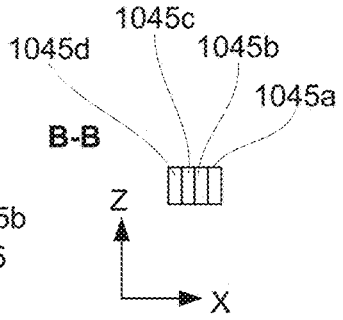

FIG. 10C illustrates flexible hybrid interconnect circuit 100 comprising openings 1043*a*-1043*c* that divide flexible hybrid interconnect circuit 100 into four strips 1045*a*-1045*d*. In some examples, each strip includes one or more conductor trace. FIG. 10D illustrates one end of flexible hybrid interconnect circuit 100 turned 90° relative to the other end within the X-Y plane, which may be referred to an in-plane bending. Openings 1043*a*-1043*c* allow flexible hybrid interconnect circuit 100 to turn and bend without significant out of plane distortions of individual strips 1045*a*-1045*d*. One having ordinary skills in the art would understand that such bending would be difficult without openings 1043*a*-1043*c* because of the flat profile of flexible hybrid interconnect circuit 100 (small thickness in the Z direction) and the relatively low in-plane flexibility of materials forming flexible hybrid interconnect circuit 100. Adding openings 1043*a*-1043*c* allows different routing of each of strips 1045*a*-1045*d*, thereby increasing flexibility and decreasing the out of plane distortion. Furthermore, selecting a particular width and length of each opening allows for specific routing and orientation of each strip and flexible hybrid interconnect circuit 100. FIGS. 10E and 10F represent cross-sections of strips 1045*a*-1045*d* at different locations of flexible hybrid interconnect circuit 100. As shown in these figures, strips 1045*a*-1045*d* may be brought closer together and rotated 90° around each of their respective center axes at some point (B-B) in the bend. To achieve this type of orientation, the length of each opening may be different or staggered as, for example, shown in FIG. 10C.

Figure 10G:
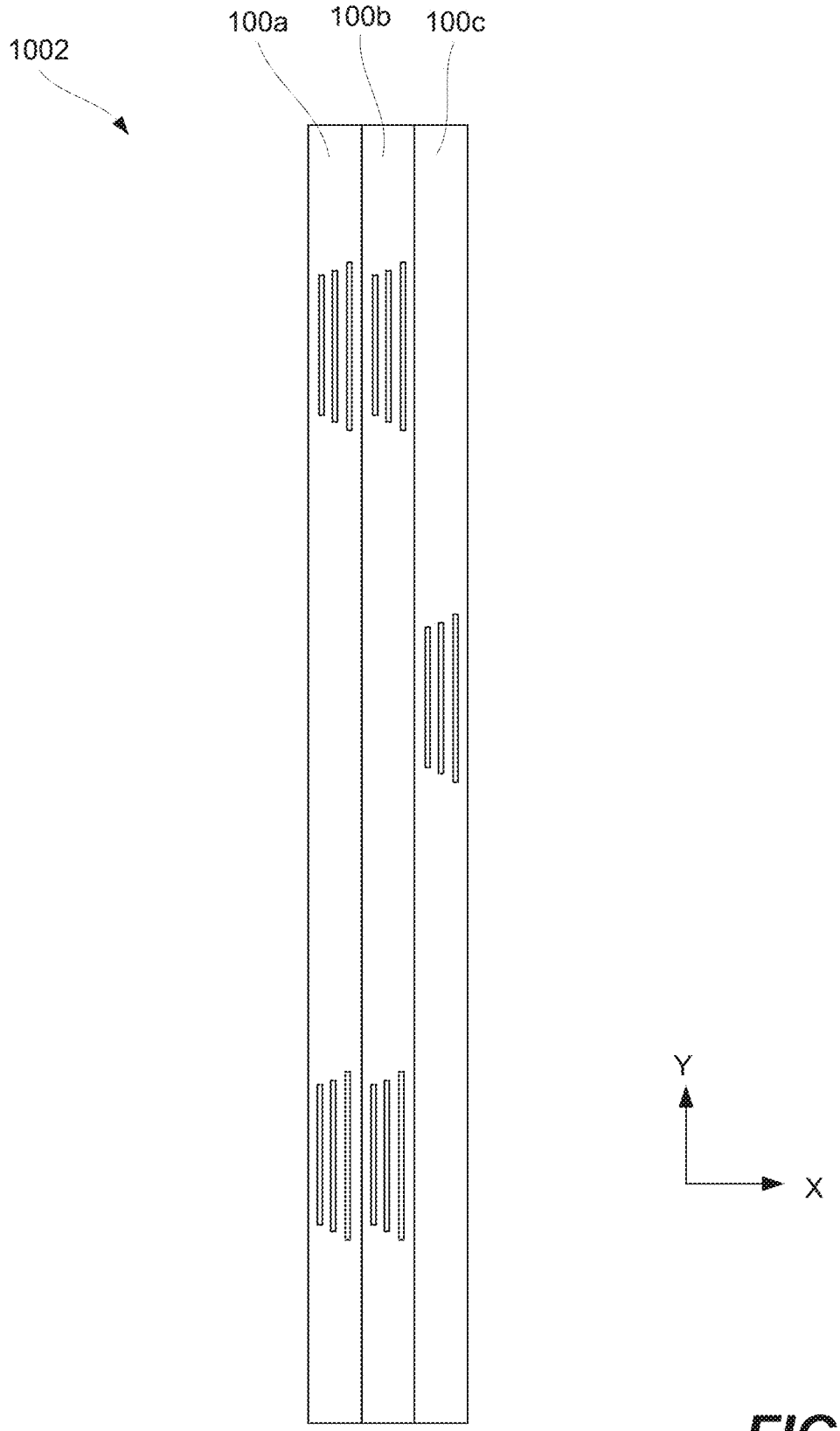
FIG. 10G illustrates an example of a production assembly of multiple flexible hybrid interconnect circuits.

FIG. 10G illustrates an example of production assembly 1002 of multiple flexible hybrid interconnect circuits 100*a*-100*c*. In some examples, flexible hybrid interconnect circuits 100*a*-100*c* are partially integrated, e.g., supported on the same releasable line or have one monolithic outer dielectric layer, which is partially cut (e.g., scored). This partial integration feature allows keeping flexible hybrid interconnect circuits 100*a*-100*c* together during fabrication and storage, e.g., up to the final use of flexible hybrid interconnect circuits 100*a*-100*c*.

Furthermore, in this example, flexible hybrid interconnect circuits 100*a*-100*c* are formed in a linear form, e.g., to reduce material waste and streamline processing. Each of flexible hybrid interconnect circuits 100*a*-100*c* is separable from assembly 1002 and is foldable into its operating shape, as for example, described above with reference to FIGS. 10C-10F.

Figure 10H:
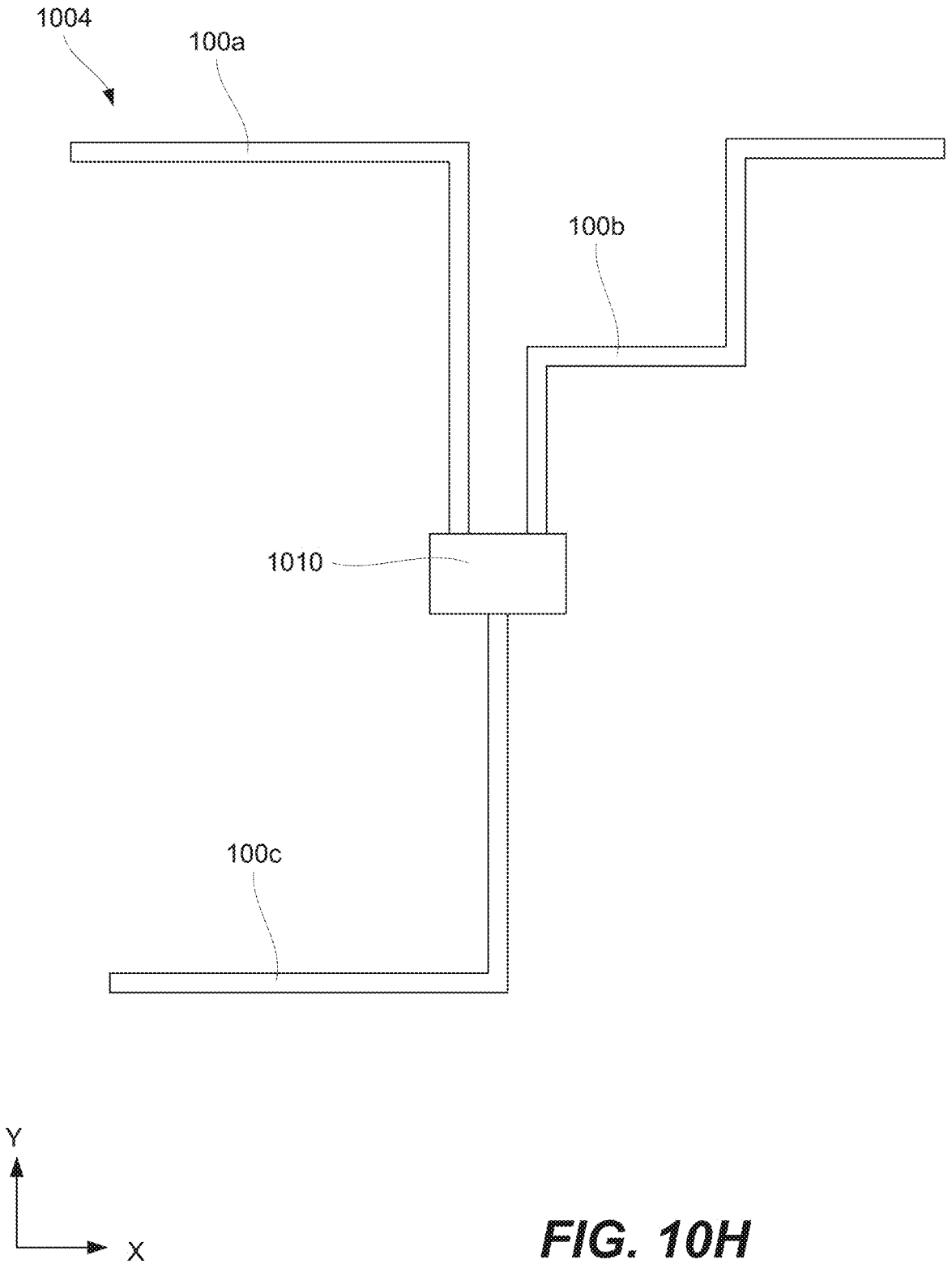
FIG. 10H illustrates of an example of an interconnect assembly comprising an interconnect hub and multiple flexible hybrid interconnect circuits.

FIG. 10H illustrates an example of interconnect assembly 1004 comprising flexible hybrid interconnect circuits 100*a*-100*c* and interconnect hub 1010. In some examples, each of flexible hybrid interconnect circuits 100*a*-100*c* is manufactured in a linear form as, for example, described above with reference to FIG. 10G. The bends in flexible hybrid interconnect circuits 100*a*-100*c* are formed during installation of flexible hybrid interconnect circuits 100*a*-100*c*, e.g., lamination of a supporting structure such as a car panel. Interconnect hub 1010 forms electrical connections between individual conductive elements in flexible hybrid interconnect circuits 100*a*-100*c*. These electrical connections are provided by conductive elements of interconnect hub 1010 positioned on one level or multiple levels (e.g., for crossover connections). Furthermore, the conductive elements of interconnect hub 1010 and the conductive elements of flexible hybrid interconnect circuits 100*a*-100*c* are either within the same plane or in different planes.

FIGS. 11A-11D—Forming Connections to Flat Conductor Traces

One challenge with using flat conductor traces in a harness is forming electrical connections between such traces and other components, such as connectors and other traces/wires, which may have different dimensions or, more specifically, smaller width-to-thickness ratios. For example, connectors for wire harnesses may use contact interfaces that are square or round, or, more generally, have comparable widths and thicknesses (e.g., have a width-to-thickness ratio of about 1 or between 0.5 and 2). On the other hand, a conductor trace in a proposed flexible circuit may have a width-to-thickness ratio of at least about 2 or at least about 5 or even at least about 10. Such conductor traces may be referred to as flat conductor traces or flat wires to distinguish them from round wires. Various approaches are described herein to form electrical connections to the flat conductor traces.

Figure 11A:
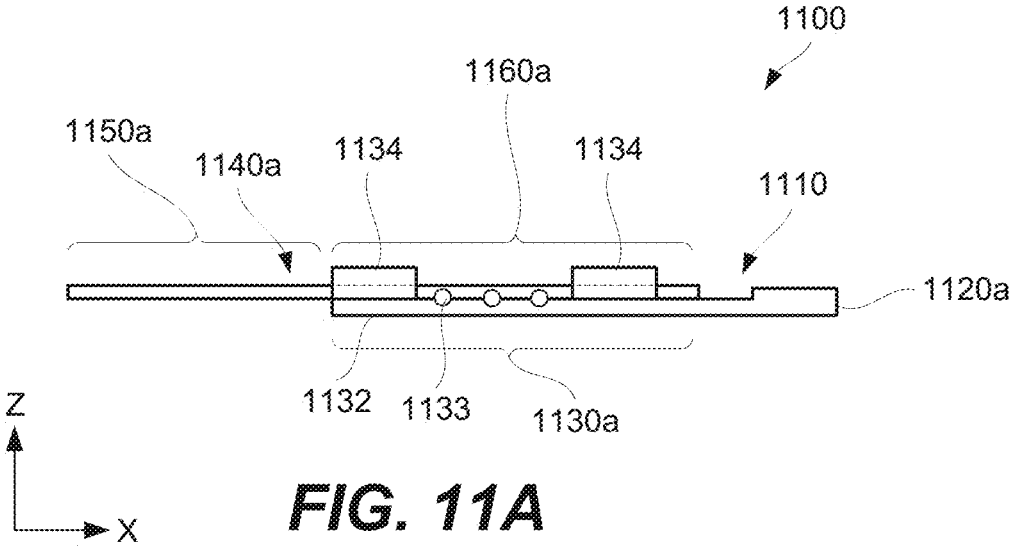
FIGS. 11A and 11B illustrate an electrical connector assembly, in accordance with some embodiments.
Figure 11B:
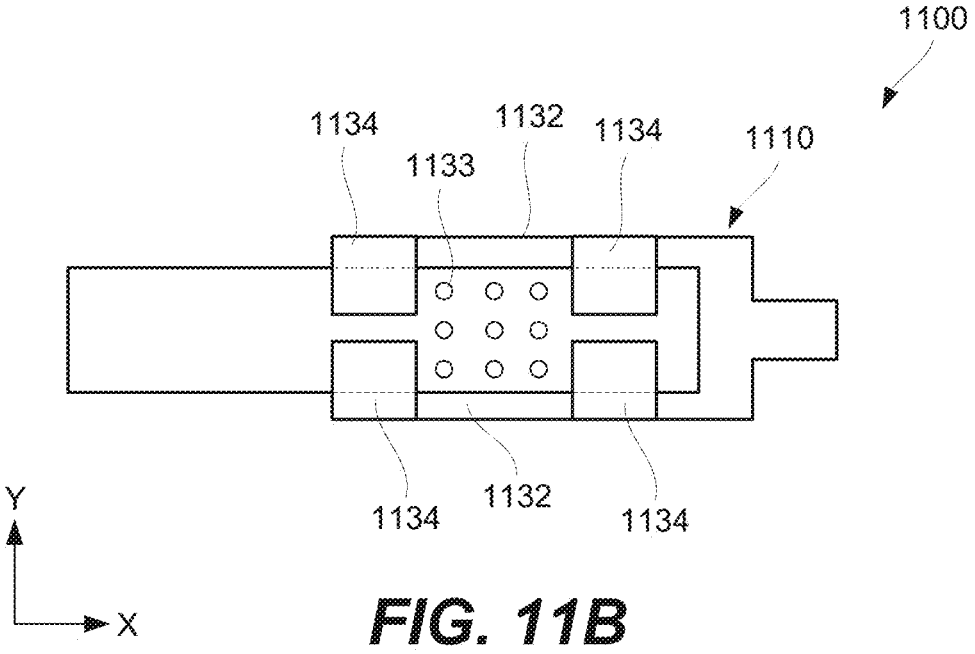

FIGS. 11A and 11B illustrate electrical connector assembly 1100, in accordance with some embodiments. Electrical connector assembly 1100 may be a part of electrical harness assembly 100 further described below. Electrical connector assembly 1100 comprises connector 1110 and conductor trace 1140*a*, which may also be referred to as first conductor trace 1140*a* to distinguish from other conductor traces of the same harness, if present. For simplicity, only one conductor trace is shown in these figures. However, one having ordinary skill in the art would understand that this and other examples are applicable to harnesses and connector assemblies with any number of conductor traces.

Connector 1110 comprises first contact interface 1120*a* and first connecting portion 1130*a*. First contact interface 1120*a* may be used to make an external connection formed by connector assembly 1100 and may be in the form of a pin, socket, tab, and the like. First contact interface 1120*a* and first connecting portion 1130*a* may be made from the same materials (e.g., copper, aluminum, and the like). In some embodiments, first contact interface 1120*a* and first connecting portion 1130*a* are monolithic. For example, first contact interface 1120*a* and first connecting portion 1130*a* may be formed from the same strip of metal.

First conductor trace 1140*a* comprises first conductor lead 1150*a* and first connecting end 1160*a*. First connecting end 1160*a* is electrically coupled to first connecting portion 1130*a* of connector 1110. Specifically, first connecting end 1160*a* and first connecting portion 1130*a* may directly contact each other and overlap within the housing of connector 1110.

In some embodiments, each connector is coupled to a different conductor trace. Alternatively, multiple connectors may be coupled to the same conductor trace. Furthermore, a single connector may be coupled to multiple conductor traces. Finally, multiple connectors may be coupled to multiple conductor traces such that all of these connectors and traces are electrically interconnected.

First conductor lead 1150*a* extends away from connector 1110, e.g., to another connector or forms some other electrical connection within connector assembly 1100. The length of first conductor lead 1150*a* may be at least about 100 millimeters, at least about 500 millimeters, or even at least about 3000 millimeters. First conductor lead 1150*a* may be insulated on one or both sides using, for example, first insulator 1142 and second insulator 1144 as schematically shown in FIG. 20 and described below. In some embodiments, first insulator 1142 and second insulator 1144 do not extend to first connecting end 1160*a*, allowing first connecting end 1160*a* to directly interface first connecting portion 1130*a*. Alternatively, one of first insulator 1142 and second insulator 1144 may overlap with first connecting portion 1130*a*, while still exposing another side of first connecting end 1160*a* and allowing this side to directly interface first connecting portion 1130*a*. In some embodiments, electrical connections to first connecting portion 1130*a* are made through openings in one of first insulator 1142 and second insulator 1144. In these embodiments, first insulator 1142 and second insulator 1144 may overlap with first connecting portion 1130*a*. In further embodiments, external insulation to first connecting end 1160*a* may be provided by connector 1110 or by a pottant or encapsulant surrounding first connecting end 1160*a*.

As shown in FIGS. 11A and 11B, both first conductor lead 1150*a* and first connecting end 1160*a* have the same thickness (e.g., formed from the same metal sheet). First connecting end 1160*a* may have a width-to-thickness ratio of at least 0.5 or, more specifically, at least about 2 or even at least about 5 or even at least about 10. The width-to-thickness ratio of first conductor lead 1150*a* may be the same or different.

In some embodiments, first connecting portion 1130*a* of connector 1110 comprises base 1132 and one or more tabs 1134. Specifically, FIG. 11B illustrates four tabs 1134 extending from base 1132 (two from each side of base 1132). However, any number of tabs can be used. First connecting end 1160*a* of first conductor trace 1140*a* is crimped between base 1132 and tabs 1134. The crimping provides electrical connection and mechanical coupling between connecting portion 1130*a* and first connecting end 1160*a*. The mechanical coupling helps to ensure that the electrical coupling is retained during operation of electrical harness assembly 100. For example, the connection between first connecting portion 1130*a* and first connecting end 1160*a* may be subject to mechanical stresses, creeping of the material (e.g., when one or both materials comprises aluminum), and the like. Furthermore, the mechanical coupling may be used to support first connecting end 1160*a* of first conductor trace 1140*a* by connector 1110.

In some embodiments, first connecting end 1160*a* of first conductor trace 1140*a* is also welded or otherwise additionally connected to base 1132 as, for example, schematically shown at locations 1133 in FIGS. 11A and 11B. This connection may be carried out using various means, including but not limited to ultrasonic welding, laser welding, resistance welding, brazing, or soldering. This connection helps form a low-resistance, stable electrical contact between first connecting end 1160*a* and interfacing base 1132, and may be referred to as a primary electrical connection to distinguish from the electrical connection provided by a direct interface between connector 1110 and first conductor trace 1140*a*. This primary electrical connection may comprise an intermix of materials of first connecting end 1160*a* and interfacing base 1132 and form a local monolithic structure at each location 1133. Therefore, if surface oxidation or other changes in surface conditions of first connecting end 1160*a* and interfacing base 1132 happen later, these changes will not impact this primary electrical coupling between first connecting end 1160*a* and interfacing base 1132.

Figures 11C, 11D:
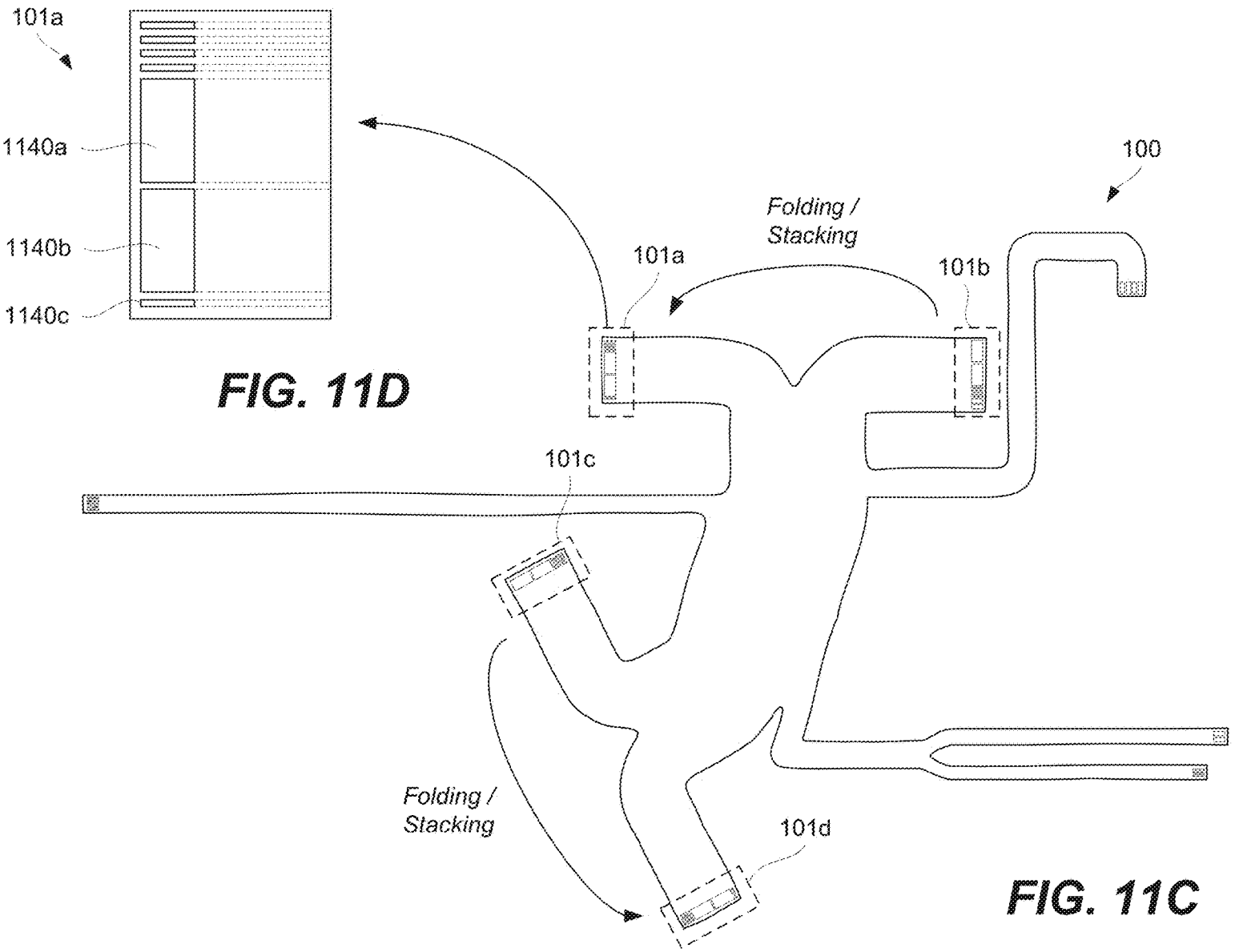
FIG. 11C illustrates an example of a partially assembled electrical harness assembly having different portions that are ready to be folded and stacked together.
FIG. 11D illustrates an expanded view of a portion of the electrical harness assembly shown in FIG. 11C.

FIG. 11C illustrates an example of flexible hybrid interconnect circuit 100 electrical harness assembly 110, which is only partially assembled and does not have connectors attached to its conductor traces. Flex circuit 100 comprises different portions 101*a*-101*d*, used for attachment of connectors. Prior to this attachment, various combinations of these different portions 101*a*-101*d* may be stacked together. For example, portion 101*a* may be stacked with portion 101*b* such that multiple conductor traces 1140*a*-1140*c* of portion 101*a* (shown in FIG. 11D) overlap with corresponding conductor traces of portion 101*b*. In a similar manner, portion 101*c* is ready to be stacked with portion 101*d* such that their corresponding conductor traces overlap. For example, portions 101*a* and 101*b* may be folded towards each other and inserted into a single connector that is able to accept and make connections to two or more rows of conductor traces. In the latter example, to prevent the conductor traces of portion 101*a* from inadvertently contacting portion 101*b* near the connector, an insulating layer may be placed in between the two portions 101*a* and 101*b*. Alternatively, portions 101*a*-101*d* or similar portions may be folded in such a way that an insulating layer, which may be also referred to as a base layer, is stacked in conductor traces on each folded end. In other words, the conductor traces remain electrically insulated even when stacked.

Conclusion

In the above description, numerous specific details are set forth to provide a thorough understanding of the disclosed concepts, which may be practiced without some or all of these particulars. In other instances, details of known devices and/or processes have been omitted to avoid unnecessarily obscuring the disclosure.

While the present disclosure has been particularly shown and described with reference to specific examples thereof, it will be understood by those skilled in the art that changes in the form and details of the disclosed examples may be made without departing from the spirit or scope of the present disclosure. The description of the different illustrative examples has been presented for purposes of illustration and description, and is not intended to be exhaustive or limited to the examples in the form disclosed. Many modifications and variations will be apparent to those of ordinary skill in the art. It is therefore intended that the present disclosure be interpreted to include all variations and equivalents that fall within the true spirit and scope of the present disclosure. Accordingly, the present examples are to be considered as illustrative and not restrictive.

Although many of the components and processes are described above in the singular for convenience, it will be appreciated by one of skill in the art that multiple components and repeated processes can also be used to practice the techniques of the present disclosure.

What is claimed is:

1. A connector for connecting to a flexible interconnect circuit, the connector comprising:

a base comprising a housing chamber defined by at least a first side wall, a second side wall, and a bottom wall, wherein the first side wall and the second side wall are oppositely positioned about the base, and wherein the bottom wall is disposed between the first side wall and the second side wall;

a circuit clamp coupled to the first side wall of the base via a first hinge, wherein the circuit clamp is configured to rotate, around the first hinge, in one of a clockwise or counterclockwise direction, from a released position to a clamped position, wherein the circuit clamp rotates towards the bottom wall when rotating from the released position to the clamped position; and a cover piece coupled to the second side wall of the base via a second hinge, wherein the cover piece is configured to rotate, around the second hinge, in an other of the clockwise or counterclockwise direction opposite that of the direction of the circuit clamp, from an open position to a closed position, wherein the cover piece rotates towards the bottom wall when rotating from the open position to the closed position.

2. The connector of claim 1, wherein the cover piece comprises one or more protrusions, each protrusion configured to interface with a corresponding socket within the first side wall or the second side wall to secure the cover piece in the closed position.

3. The connector of claim 1, further comprising the flexible interconnect circuit.

4. The connector of claim 1, wherein the circuit clamp is configured to secure the flexible interconnect circuit between the base and the circuit clamp in the clamped position.

5. The connector of claim 4, wherein the circuit clamp comprises one or more protrusions, each protrusion configured to interface with a socket within the first side wall or the second side wall to secure the circuit clamp in the clamped position.

6. The connector of claim 4, wherein the circuit clamp includes a convex upper surface, wherein the flexible interconnect circuit conforms to a geometry of the convex upper surface in the clamped position.

7. The connector of claim 6, wherein the base comprises one or more blade openings configured to receive blades of a module-side connector.

8. The connector of claim 7 wherein the cover piece comprises a contact surface within the housing chamber in the closed position, wherein the contact surface comprises one or more convex portions which are offset from the convex upper surface of the circuit clamp.

9. The connector of claim 7, wherein the cover piece comprises an upper contact surface, the upper contact surface comprising one or more convex portions which are offset from the convex upper surface of the circuit clamp.

10. The connector of claim 6, wherein the circuit clamp comprises a clamp grip surface.

11. The connector of claim 10, wherein the clamp grip surface is disposed on a bottom side of the circuit clamp opposite that of the convex upper surface.

12. The connector of claim 11, wherein the base further comprises a base grip surface.

13. The connector of claim 12, wherein the clamp grip surface and the base grip surface are aligned to provide securing forces against opposing sides of a first portion of the flexible interconnect circuit when the flexible interconnect circuit is received by the connector and the circuit clamp is in the clamped position.

14. The connector of claim 11, wherein the circuit clamp is configured to contact the flexible interconnect circuit with both the bottom side and the convex upper surface when the flexible interconnect circuit is received by the connector and the circuit clamp is in the clamped position.

* * * * *